US005108097A

United States Patent [19]

Ashihara

[11] Patent Number: 5,108,097

[45] Date of Patent: Apr. 28, 1992

[54] MULTI-FUNCTIONAL POLICE BATON

[76] Inventor: Hideyuki Ashihara, 360-1, Samban-cho 8-chome, Matsuyama-shi, Ehime-ken, Japan

[21] Appl. No.: 754,831

[22] Filed: Sep. 4, 1991

[30] Foreign Application Priority Data

Sep. 5, 1990 [JP] Japan ..... 2-234705
Dec. 17, 1990 [JP] Japan ..... 2-402616
Mar. 22, 1991 [JP] Japan ..... 3-57583

[51] Int. Cl.[5] ..... F41B 15/02
[52] U.S. Cl. ..... 273/84 R
[58] Field of Search ..... 273/84; 446/123-126

[56] References Cited

U.S. PATENT DOCUMENTS 4,132,409 1/1979 Taylor ..... 273/84
4,355,804 10/1982 Bingham ..... 273/84 R
4,655,456 4/1987 Dai ..... 273/84 R
4,703,932 11/1987 Kubota ..... 273/84 R

FOREIGN PATENT DOCUMENTS 61-181996 11/1986 Japan .
63-90796 6/1988 Japan .
2-50091 2/1990 Japan .
2-50092 2/1990 Japan .
2-147076 6/1990 Japan .

*Primary Examiner*—Paul E. Shapiro
*Attorney, Agent, or Firm*—Armstrong, Nikaido, Marmelstein, Kubovcik, and Murray

[57] ABSTRACT

A multi-functional police baton comprising a baton main body having a gripping portion at one end in the longitudinal direction, an attachment having a ring-like insertion portion through which the baton main body is inserted and which is detachably fit to a base end position of the gripping portion and an extended portion extended sideways from the insertion portion, and a coupling device of a male and female paired structure comprising a latch of a movable structure for inhibiting the axial movement and a device for engagement with the latch, in which one of the components of the coupling device is disposed to the baton main body, while the other of the components of the coupling device is disposed to the insertion portion of the attachment. The extended portion of the attachment can be optionally selected from various kinds of forms, depending on which the functions of the police baton can be varied.

12 Claims, 26 Drawing Sheets

20
22f
23
22d
22c
22
22e
22a
21
13c
19
18
16a
16
13b
13
5
16b
15
13a
14
4
2
12
10
10a
7
7a
3
118
9
25
26
27
34
1
36
32
38
33
35
29
A
30

20
22f
22d
22c
22
21
13c
19
18
13
13b
16
5
2
4
16A
12
25
26
1
36
27
5
40
3A
43
9
5
A
30

2
5
4
43

1
41
42
40
4
9
A

MULTI-FUNCTIONAL POLICE BATON

BACKGROUND OF THE INVENTION

1. Field of the Invention

The present invention concerns a multi-functional police baton with a crosshandle, a guard, single-sided hook, crotched hook or the like disposed detachably at a position of a baton main body localized to one end and capable of functioning as a police baton with crosshandle, a police baton with guard, a JUTTE-type police baton and a SAI-type police baton, respectively.

2. Description of the Prior Art

As police batons carried by policemen or guardsmen, a simply straight police baton and a so-called police baton with crosshandle have been known.

The police baton with crosshandle of the above-mentioned type has a baton main body and a crosshandle branched in perpendicular from the baton main body at a position localized longitudinally from the center to one end of the baton main body. A user of the police baton usually grips the crosshandle with his little finger positioned on the side near the baton main body and manipulates the baton while controlling the gripping force. The user performs offense and defense to strike an opponent, for example, by rotating the baton around the axis of the crosshandle while thrusting the baton main body, suddenly stopping the rotation or projecting the baton main body along its axial direction.

One of such police batons with crosshandle of the above-mentioned type has been disclosed in, for example, Japanese Patent Application Hei 1-75529 previously proposed by the present applicant, in which a baton main body of a police baton with crosshandle has a telescopic structure comprising a plurality of hollow cylindrical members each of different diameter. If the baton main body is contracted, it can be put into a holder and suspended from a waist or shoulder of a user like that a hand gun and can be carried about without being observed and giving no threatening impression if he puts on a suit or a jacket over it.

Further, as a similar club-like protecting tool or a weapon, JUTTE (a short rod having an auxiliary hook disposed on one side) or SAI (a rod having crotched hook on both sides) has been known long since.

As a conventional structure for attaching or detaching an attachment to and from a police baton, Japanese Utility Model Laid-Open Sho 63-90796 proposes a structure in which a guard is secured as an attachment to a simply straight rod-like police baton. In this structure, a guard made of a metal thin plate is detachably mounted to a police baton having a gripping haft at one end of a rod member which is made telescopic in the longitudinal direction. The guard made of a metal thin plate is mounted detachably to the police baton, by forming an opening in a central portion of a metal tongue plate, forming a circumferential groove substantially at one-half thickness along the outer circumferential side of a rubber ring that has an inner diameter equal with an outer diameter of the police baton rod member in the vicinity of the base end thereof and having an appropriate thickness, fitting the outer circumferential groove to the opening in the metal plate to constitute a guard and fitting the rubber ring around the circumferential periphery of the rod member from the end and passing it as far as the base end of the gripping haft.

The simple straight police baton described above is easy in the way of use and suitable to general use but it involves a drawback that a hand gripping the haft is exposed to the outside tending to be injured by opponent's weapon or the like.

On the other hand, in the police baton with crosshandle, when it is used like that a straight police baton by gripping the haft of the main body, the crosshandle serves as a guard to protect the gripping hand. On the other hand, when it is used by gripping the cross handle, quick motion, high speed rotation, sudden starting or stopping, or jabbing from out of the opponent's view which is difficult to be forecast and, accordingly, it is considered more effective than the simply straight baton. However, it requires a considerable period of time for training to get skilled in the manipulation for controlling the movement of a rod main body by adjusting the gripping force to the cross handle. In addition, there has been a problem that a crosshandle protruding in perpendicular to the baton main body is in the way when it is intended to carry about the police baton without being observed, for example, in a state where a policeman disguises himself into light wears without a suit or jacket or in a case where it is contained in a more compact state, upon secret investigation.

Further, although JUTTE and SAI have not been used so far as a police baton, they have a merit capable of putting an opponent's cutlery between a rod member and a hook extended sideways and wrenching it off.

OBJECT OF THE INVENTION

The present invention has been accomplished taking notice on merits and demerits of existent police batons or protecting tools of the respective types and it is an object thereof to provide a multi-functional police baton capable of serving as a straight police baton with guard for protecting a gripping hand, a police baton with crosshandle in which the crosshandle is detachable as necessary upon carrying about or transportation, and also as a JUTTE-type police baton or SAI-type police baton, so that the foregoing problems in the prior art can be dissolved and the functions of the respective types of the police batons can be utilized more effectively as required.

Further, in the existent structure of attaching a guard to a police baton, since a guard made of a metal thin plate is fit around the outer circumference of a rubber ring and the rubber ring is fit around the police baton there has been a problem, apart from a light and small attachment such as a guard made of thin metal plate, that an attachment which is thick, facit and heavy weight and, in particular, an attachment extended sideways in the longitudinal direction from one side of the police baton, can not be stabilized effectively but jolts instably, failing to be put to a practical use.

It is, accordingly, another object of the present invention to overcome the foregoing problems by providing an attachment mounting and detaching structure capable of mounting and detaching even an attachment which is thick facit and heavy in weight or an attachment extended sideways in the longitudinal direction from one side of the police baton firmly and stably and in one touch action, thereby providing a police baton capable of giving various functions as required and conforming with emergent cases.

SUMMARY OF THE INVENTION

The foregoing object of the present invention can be attained by a police baton comprising baton main body having a gripping portion at one end in the longitudinal direction, an attachment having a ring-like insertion portion extended in the axial direction, through which the baton main body is inserted and which is detachably fit to a base end position of the gripping portion and an extended portion extended sideways from the insertion portion, and a coupling device of a male and female paired structure comprising a latch means of a movable structure for inhibiting the axial movement and means for engagement with the latch means, in which one of the means of the coupling means is disposed to said baton main body, while the other of the means of the coupling means is disposed to the insertion portion of the attachment.

The extended portion of the attachment may be selected optionally from a crosshandle, guard, hook, single-sided hook (JUTTE), and crotched hook (SAI).

Further, the coupling device may comprise a forked spring or leaf spring secured at one end to the baton main body and having an engaging protrusion at the other end as the latch means and an insertion groove for the spring disposed to the inner surface of the insertion portion of the attachment as a means for engagement with the latch means.

Further, the latch means may be a lock nut having a female thread on one end and attached rotatably and axially movably to the end of the insertion portion of the attachment, and the means for engagement therewith may be a cylindrical member having a male thread at one end and an anti-rotational protrusion at the outer surface and secured to the baton main body.

Further, the latch means may be a lock member having a protrusion movable in the radial direction of the baton main body and attached to the insertion portion of the attachment by way of a resilient member and the means for engagement therewith is a recess formed to the circumferential side of the baton main body.

Further, in a case where the extended portion of the attachment is a guard, at least one of shooting devices for light, acoustic wave, electromagnetic wave, gas, liquid and solid can be detachably attached to the guard.

In a case where the extended portion of the attachment is formed as a guard, since the police baton with guard can be obtained in one touch action, the gripping hand can be protected even when attacked by a rod, cutlery or the like, and it facilitates to positively attack and suppress an opponent.

In a case where the attachment is formed as a crosshandle, since a police baton with crosshandle capable of more effective offense and defense than simply straight police baton can be obtained, more powerful and rapid suppression is possible. Then, in a case where the police baton is intended to be carried about not being observed when a user disguises himself into light wears with no over ware in secret inspection or the police baton is intended to be contained in a more compact manner, the crosshandle can be detached easily.

In a case where a single sided hook (JUTTE hook) or crotched hook (SAI hook) is used as the extended portion of the attachment a new type of police baton not known so far can be obtained. With the police baton having such a hook, when an opponent attacks by a weapon such as a rod or cutlery, it is possible to wrench off the weapon. In particular, with the SAI-type police baton, it is possible to suppress an opponent by dazzling or haltering him by a complicate way of use not attainable in the existent police baton such as changing the grip from a normal gripping like that for a sword into a reverse gripping.

The present invention also includes such an embodiment in which the coupling device comprises a resiliently extendible retainer ring having a generally C-shaped outer shape and having protrusion pieces protruding to the inner radial side as a latch means, a retainer ring engaging recess formed to the outer surface of the baton main body as a means for engagement with the latch means and a retainer ring groove disposed to the outer surface of the insertion portion of the attachment for fitting the retainer ring, in which a portion of the bottom of the retainer ring groove is cut to form an opening, and protrusions of the retainer ring are protruded from the inner surface of the insertion portion of the attachment so as to be engageable with the retainer ring engaging recess at the outer surface of the baton main body.

In this embodiment, the retainer ring is always fit into the retainer ring groove in the insertion portion of the attachment. The protrusion pieces of the retainer ring protrude from the opening of the retainer ring groove to the inner surface of the insertion portion. Upon mounting the attachment to the baton main body, the top end of the police baton is urged into the insertion portion of the attachment. Then, the protruding pieces of the retainer ring protruding to the inner surface of the insertion portion are extended by being urged from the outer surface of the baton main body. Then, the attachment is gripped and pressed as it is to the base end of the gripping haft. When the protrusions of the retainer ring reach the retainer ring engaging recess at the outer surface of the baton main body, they resiliently restore from the extended state to engage the recess. In this way, the attachment can be mounted to the baton main body by merely gripping the attachment and pressing it to the base end of the haft. Furthermore, since it is mounted by way of the retainer ring attached to the insertion portion, it can be completely prevented from slipping off and is firmly stabilized.

Upon detaching the attachment, the ends of the retainer ring exposed to the opening of the retainer ring groove of the attachment are widened to extend the ring, and the engagement between the protruding pieces and the retainer ring engaging recess is released to withdraw the attachment from the baton main body. Since the retainer ring is always fit as it is in the retainer ring groove of the attachment, there is no worry of missing it.

The present invention further include an embodiment in which the coupling device of the attachment comprises a latch means of a movable structure in which a resilient engaging plate is attached to the circumferential side of the insertion portion of the attachment, with one end being constituted as a fixing end and the other end being constituted as a free end formed with an inwardly protruding engaging portion and means for engagement with the latch means, formed to the outer surface of the baton main body, as an engaging portion for engaging the engaging protrusion of the resilient engaging means.

In this case, the resilient engaging plate is always attached to the insertion portion of the attachment. The engaging protrusions of the resilient engaging plate protrude to the inside. Upon mounting the attachment to the baton main body, the top end of the baton main body is urged into the insertion portion of the attachment. The engaging protrusions of the resilient engaging plate are extended being urged by the outer surface of the baton main body. Then, the attachment is urged as it is to the base end of the gripping haft to engage the engaging protrusions of the resilient engaging plate with the engaging portion of the baton main body. In this way, the attachment can be mounted simply and firmly to the baton main body. The attachment can be detached by outwardly opening the free ends of the resilient engaging plate and releasing the engagement between the engaging protrusions and the engaging portion and, subsequently, withdrawing the attachment from the baton main body.

When the extended portion of the attachment is formed as a single sided hook (JUTTE) or crotched hook (SAI), a new type police baton can be obtained. With a police baton having such a hook, even when an opponent attacks by a weapon such as a rod or cutlery, it is possible to wrench off his weapon.

When the structure for mounting and the detaching the attachment of the police baton is made in common, since compatibility is attainable among various kinds of attachments, it is possible to vary the function of the police baton, as necessary, for example, as usual rod-like police baton, police baton with guard, police baton with crosshandle, JUTTE-form police baton and SAI-form police baton.

When the coupling device of the attachment is equipped with common latch means and engaging means, since compatibility is attainable among various kinds of attachments, it is possible to use a police baton in various ways such as a usual rod-like police baton, a police baton with guard, a police baton with crosshandle, a JUTTE-form police baton and a SAI-form police baton respectively.

DESCRIPTION OF THE ACCOMPANYING DRAWINGS

These and other objects, features, as well as advantageous effects of the present invention will become apparent by reading the following descriptions for the preferred embodiments according to the present invention with reference to the accompanying drawings, wherein FIG. 1 is a side elevational view partially in vertical cross section of a first embodiment according to the present invention;

DETAILED DESCRIPTION OF THE PREFERRED EMBODIMENT

The present invention will now be described by way of its preferred embodiments with reference to the accompanying drawings.

Figures 1, 2, 3:
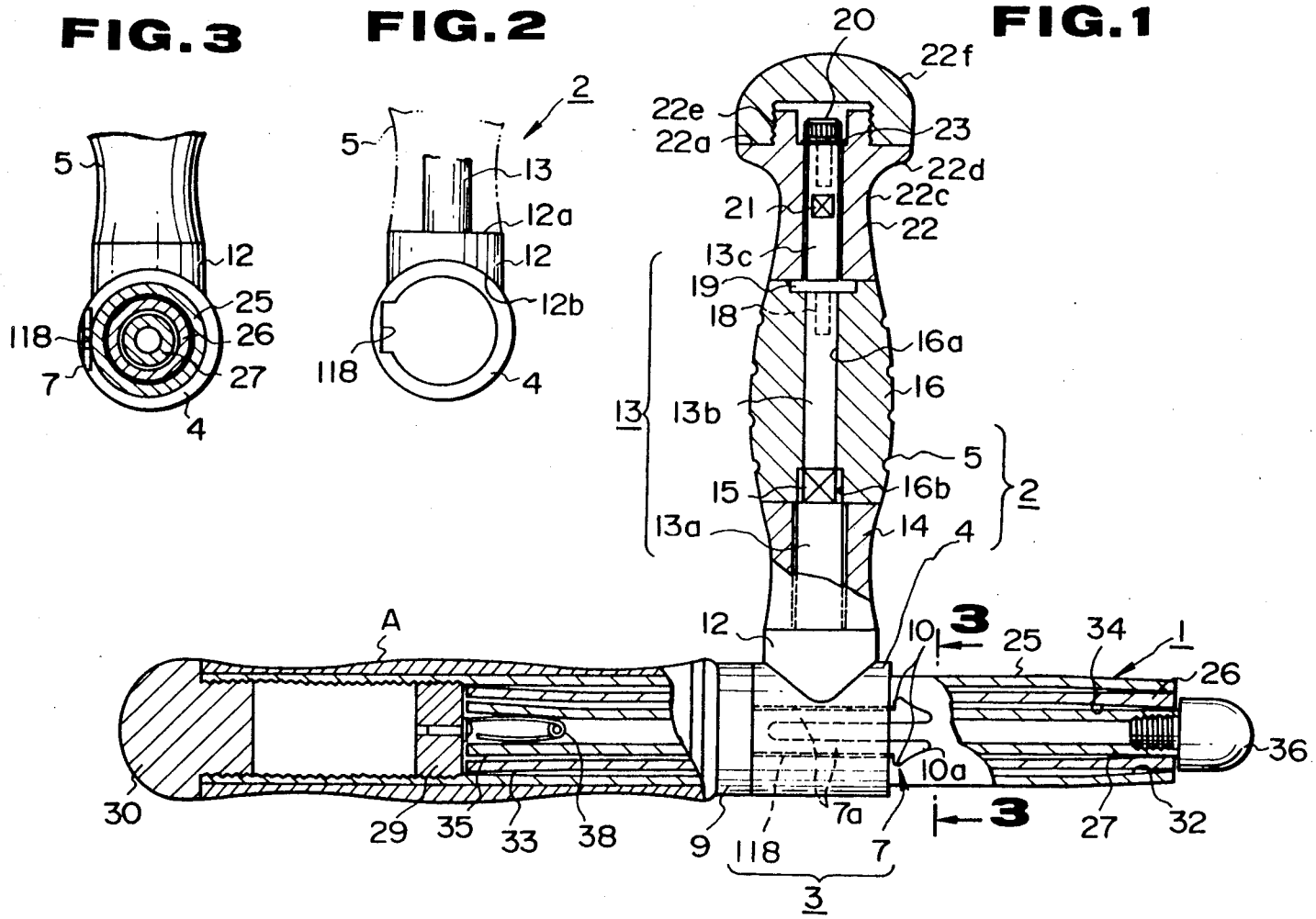
FIG. 2 is a front elevational view of an attachment shown in FIG. 1.
FIG. 3 is a cross sectional view taken along lines 3—3 in FIG. 1.

FIG. 1 through FIG. 3 illustrate a first embodiment of the present invention. In the drawings, reference numeral 1 denotes a baton main body. The baton main body 1 has an attachment 2 branched in perpendicular from the baton main body 1 disposed at a position between the longitudinal center and one end of the baton main body 1, that is, at a position near a grip A disposed at the front end of the baton main body 1 (front grip) by way of a coupling device. The attachment 2 has an insertion portion in the form of a ring extended in the axial direction and a crosshandle 5 extended sideways from the annular insertion portion 4 and having such a length that can be gripped by one hand.

The coupling device 3 has a male and female paired structure comprising a forked spring 7 as a latch means and a spring insertion groove 8 as a means for engaging the forked spring 7. The forked spring 7 is secured at one end to a fixing ring 9 put around the periphery of the baton main body 1 and secured to a base end of the front grip A by means of screwing, welding, bonding or the like. Spring main body 1 *7a* forked in parallel a slight distance is extended axially along the outer surface of the baton main body 1 and have jaws 10, at the top end, protruding outward in the lateral direction of the spring for engagement with the end face of the insertion portion 4. The jaws 10 are movable toward the inside of the lateral direction of the spring by the resilient deformation of the spring main body *7a* so as to narrow the gap between each other. The spring insertion groove 8 has a width corresponding to that of the main body *7a* of the forked spring and is formed along the inner surface of the insertion portion 4 over the entire length thereof.

The crosshandle 5 in this embodiment is of an upper and lower rotational type. As shown in FIG. 2, a mounting base 12 at the lower end has an upper surface *12a* formed into a flat surface and a lower surface *12b* formed into a saddle-like curved surface. The lower surface *12b* is brought into an intimate contact with the cylindrical surface of the insertion portion 4, and fixed integrally by securing means such as welding. A shaft 13 for the cross handle 5 is disposed vertically to the upper surface *12a*. A relatively rotational lower member 14 is rotatably fit loosely around the periphery of the base end *13a* of the shaft 13. The outer circumferential surface of a base end 13 protruding upward of the relatively rotational lower member 14 is chamfered to form a flat surface 14. An intermediate portion *13b* extended upward from the base end *13a* is surrounded with a static member 16. The static member 16 has a central shaft insertion bore *16a*, the lower portion of which is formed as a long hole *16b* having a flat portion. The flat surface 15 of the shaft base end *13a* is fit to the this portion to render the static member 16 not rotatable. The intermediate portion *13b* further has a top end *13c* screwed therewith. The top end *13c* has a male screw 18 for screwing with the top end of the intermediate portion *13b* and a guard 19 extended in the form of a disc at the lower portion, and a female thread bore for screwing with a bolt 20 at the upper portion, and further has a chamfered flat surface 21 formed at the outer circumferential surface for engagement with a wrench. A relatively rotational upper member 22 is rotatably fit around the top end *13c*. The bolt 20 is screwed by way of a washer 23 to the top of the top end *13c* to hold the relatively rotational lower member 14, the static member 16 and the relatively notational upper member 22 so that they do not slip off. The relatively rotational upper member 22 is mounted not only by the bolt but also by means of retainer ring, welding, bonding or the like.

The static member 16 has an elliptic or like other non-circular transverse cross sectional shape at the middle portion and its longer diameter is aligned with the axial direction of the baton main body 1 so as to obtain a reliable directionality of the police baton with crosshandle.

In the relatively rotational upper member 22, the diameter of the outer circumferential surface *22c* is gradually decreased upward from the lower end and the diameter is abruptly increased in the upper portion to form an anti-slip retaining portion *22d*. The retaining portion 22 has such a diameter as to ensure sufficient engagement upon gripping by positioning the thumb and the forefinger around the outer circumferential surface *22c*. A male screw *22e* is protruded at the center of the upper surface *22a* just above the retaining portion *22d*, to which an upper cap *22f* is screwed. The crosshandle 5 is assembled in this way.

Rolling bearings or sliding bearings using a resin of a low friction coefficient such as a fluro resin or a polyimide resin may be incorporated in the relatively rotational lower member 14 and the relatively rotational upper member 22 of the crosshandle 5. This can facilitate a more smooth high speed movement regarding the relative rotation of the relatively rotational lower member 14 and the relatively rotational upper member 22. Although not illustrated, in particular, such bearings may, of course be used also in other embodiments.

Referring then to the baton main body 1 of this embodiment, it comprises a plurality (three in this embodiment) of cylindrical member 25, 26 and 27 each having a different diameter and combined in a telescopic structure. The outer cylinder 25 of the largest diameter has a plug 29 screwed at the inside and a cap 30 screwed at the rear end. The top end of the outer cylinder 25 has an inclined surface 32 at least at the inner surface and the inner diameter is slightly reduced toward the opening at the top end. The intermediate cylinder 26 contained at the inside of the outer cylinder 25 has an inclined surface 33 on the side of the rear end at least at the outer surface, and the outer diameter is slightly enlarged toward the opening at the rear end. The inclined surface 33 engages the inclined surface 32 formed at the inner surface of the opening at the top end of the outer cylinder 25. Further, the top end of the intermediate cylinder 26 has an inclined surface 34 formed at least at the inner surface thereof and the inner diameter is slightly reduced toward the opening of the top end. An inner cylinder 27 contained at the inside of the intermediate cylinder 26 has an inclined surface 35 formed at least at the outer surface on the side of the rear end and the outer diameter thereof is slightly enlarged toward the opening of the rear end. The inclined surface 35 engages the inclined surface 34 at the inner surface of the opening at the top end of the intermediate cylinder 26. A cap 36 is screwed to the top end of the inner cylinder 27. The inner cylinder 27 can engage at its rear end to a retaining spring 38 screwed to the plug 29.

In a state where each of the cylinders 25, 26 and 27 is contained successively as shown in FIG. 1, when a rotating force is applied to the baton main body 1, for instance, by gripping the crosshandle 5, the intermediate cylinder 26 and the inner cylinder 27 are thrusted and extended outward by the centrifugal force. In this case, the inclined surface 33 at the rear end of the intermediate cylinder 26 thrusted from the outer cylinder 25 engages the inclined surface 32 at the top end of the outer cylinder 25, while the inclined surface 35 at the rear end of the inner cylinder 27 thrusted from the intermediate cylinder 26 engages the inclined surface 34 at the top end of the intermediate cylinder 26 and they are inhibited from slipping out. The angle of inclination for each of the inclined surfaces 32, 33, 34 and 35 is set such that engagement between each of the inclined surfaces is released and they can be contracted by applying an external force greater than a predetermined level in the opposite direction to the top end of the baton main body 1 in the extended state. It is designed such that the base of the cap 36 at the top end of the inner cylinder 27 has a size large enough to retain the top end of the intermediate cylinder 26, and the retaining spring 38 has a resiliency strong enough to prevent the intermediate cylinder 26 and the inner cylinder 27 from accidentally slipping out by a slight force (for example, a force slightly greater than the own weight of both of the cylinders 26 and 27). The anti-slip mechanism is not necessarily restricted only to the retaining spring 38 but it may be a spring of other shape or a magnet.

The operation of this embodiment will now be described.

In a case where the police baton with crosshandle is intended to be used as a simple rod-like police baton or to be transported or carried about in a compact state, the attachment 2 is detached from the baton main body 1. In this case, both of the jaws 10 of the forked spring 7 of the coupling device 3 are put between fingers and moved inward of the lateral direction, to release the engagement between the jaws 10 and the insertion portion 4. Then, the insertion portion 4 is withdrawn from the baton main body 1. Since the jaws 10 of the forked spring 7 released from the engagement are urged to the inner wall surface of the spring insertion groove 8 and the spring main body 7*a* is resiliently deformed to narrow the aparting gap, the portion can be withdrawn easily.

On the contrary, in a case of mounting the attachment 2 to the baton main body 1, the insertion portion 4 is put around the periphery of the baton main body 1 and forced to the base end of the front grip A and the forked spring 7 is inserted into the spring insertion groove 8 of the annular insertion portion 4. When the end face of the insertion portion 4 abuts against the inclined surface 10*a* of the jaws 10 of the forked spring 7, the aparting gap of the forked spring 7 is narrowed and the jaws 10 pass the inside of the spring insertion groove 9. After passing through the insertion groove 8, the jaws 10 apart by the resiliency and engage the end face of the insertion portion 4. Thus, the attachment 2 can be mounted by one-tough action and, at the same time, inhibited from axial movement. Rotational movement of the attachment 2 around the axis of the baton main body 1 is also inhibited by the engagement between the forked spring 7 and the spring insertion groove 8. Further, since the insertion portion 4 is in the form of the ring extended in the axial direction, jolting or rattling of the attachment 2 in the axial direction can be prevented effectively and a perpendicular relation between the crosshandle 5 and the baton main body 1 can be attained easily. Accordingly, when the baton main body 1 is rotationally manipulated by gripping the crosshandle 5, movement of the baton main body 1 can surely be controlled to effectively provide the performance as the police baton with crosshandle.

A user of the police baton can use the baton as if it were a sword by gripping the front grip A at the end of the baton main body 1, in which the crosshandle 5 functions as a guard to protect the gripping hand.

In the case of rotating the baton main body while gripping the crosshandle 5, a user grips the baton by positioning the thumb and the forefinger of his one hand around the outer circumferential surface 22*c* of the relatively rotational upper member 22 of the crosshandle 2. Further, the little finger is positioned around the relatively rotational lower member 14 of the crosshandle 5. In the rotating manipulation, rotational force is given by the movement of the arm and the wrist, while the gripping force other than that of the thumb, the forefinger and the little finger is loosened to release the static member 16 of the crosshandle 5. The relatively rotational upper member 22 and the relatively rotational lower member 14 are fixed while being gripped in the hand. On the other hand, the static member 16, the baton main body 1 and the shaft 13 are rotated integrally around the shaft 13 as the axis of rotation. When the rotation is to be stopped, the static member 16 is firmly gripped again to apply a braking effect to the rotation of the baton main body 1.

Also during rotational manipulation, the thumb and the forefinger firmly holding the relatively rotational upper member 22 of the crosshandle are engaged against the retaining portion 22*d*. Accordingly, the police baton is neither displaced downward nor slipped off the hand even when violent rotational operations are repeated.

Further, since the relatively rotational upper member 22 and the relatively rotational lower member 14 smoothly rotate relative to the static member 16, the rotation of the baton main body 1 is extremely smooth, to provide sweeping at a high speed. Accordingly, even when the user is suddenly attacked by an opponent with a weapon or the like, he can instantly sweep off the opponent's weapon.

The present invention will further be explained referring to other embodiments. In each of the following embodiments, identical or corresponding portions with those in the previous embodiment carry the same reference numerals, for which duplicate descriptions will be omitted.

Figures 7, 8:
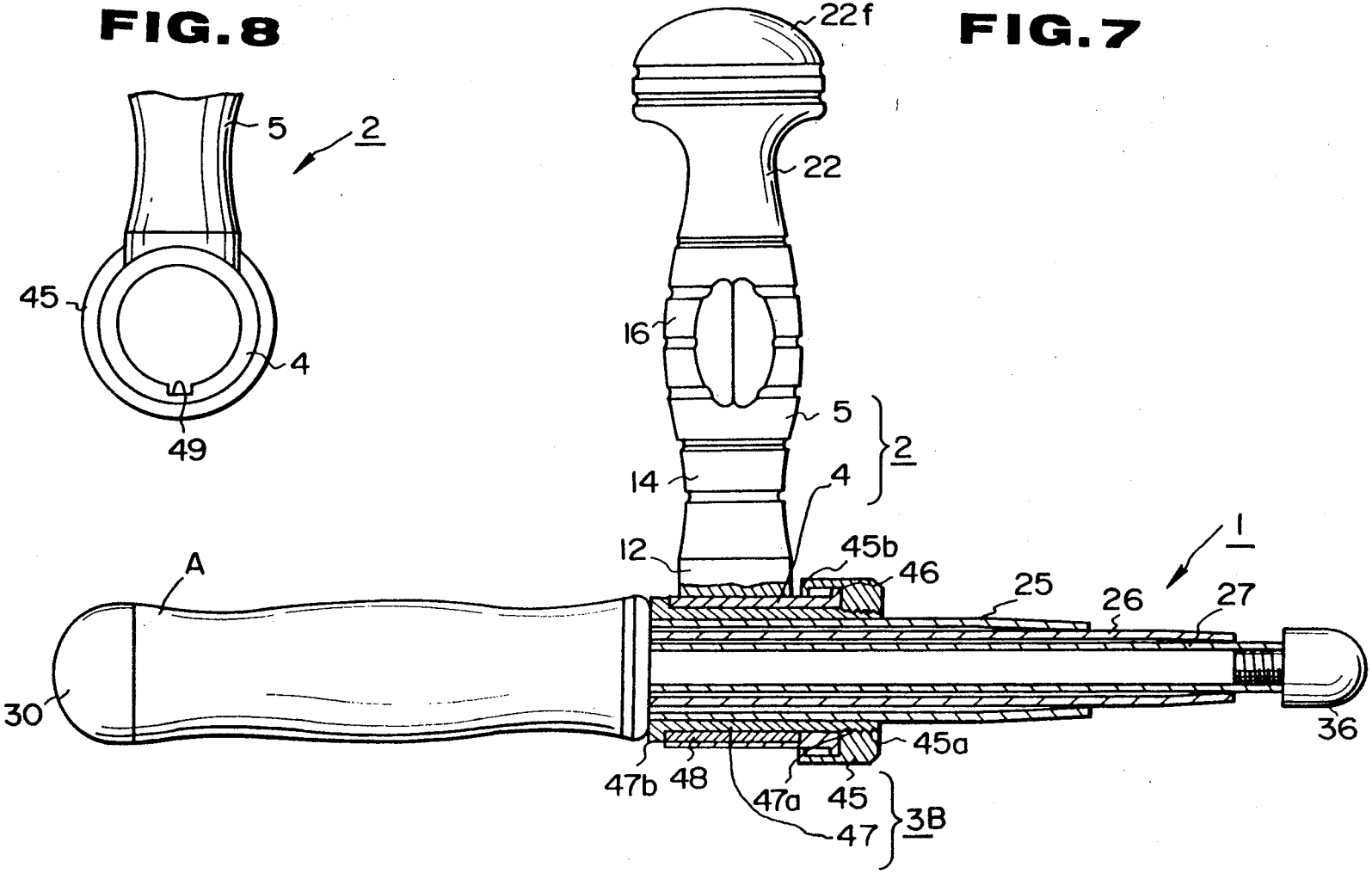
FIG. 7 is a side elevational view partially in vertical cross section of a third embodiment according to the present invention.
FIG. 8 is rear view of an attachment shown in FIG. 7.
Figures 9, 10:
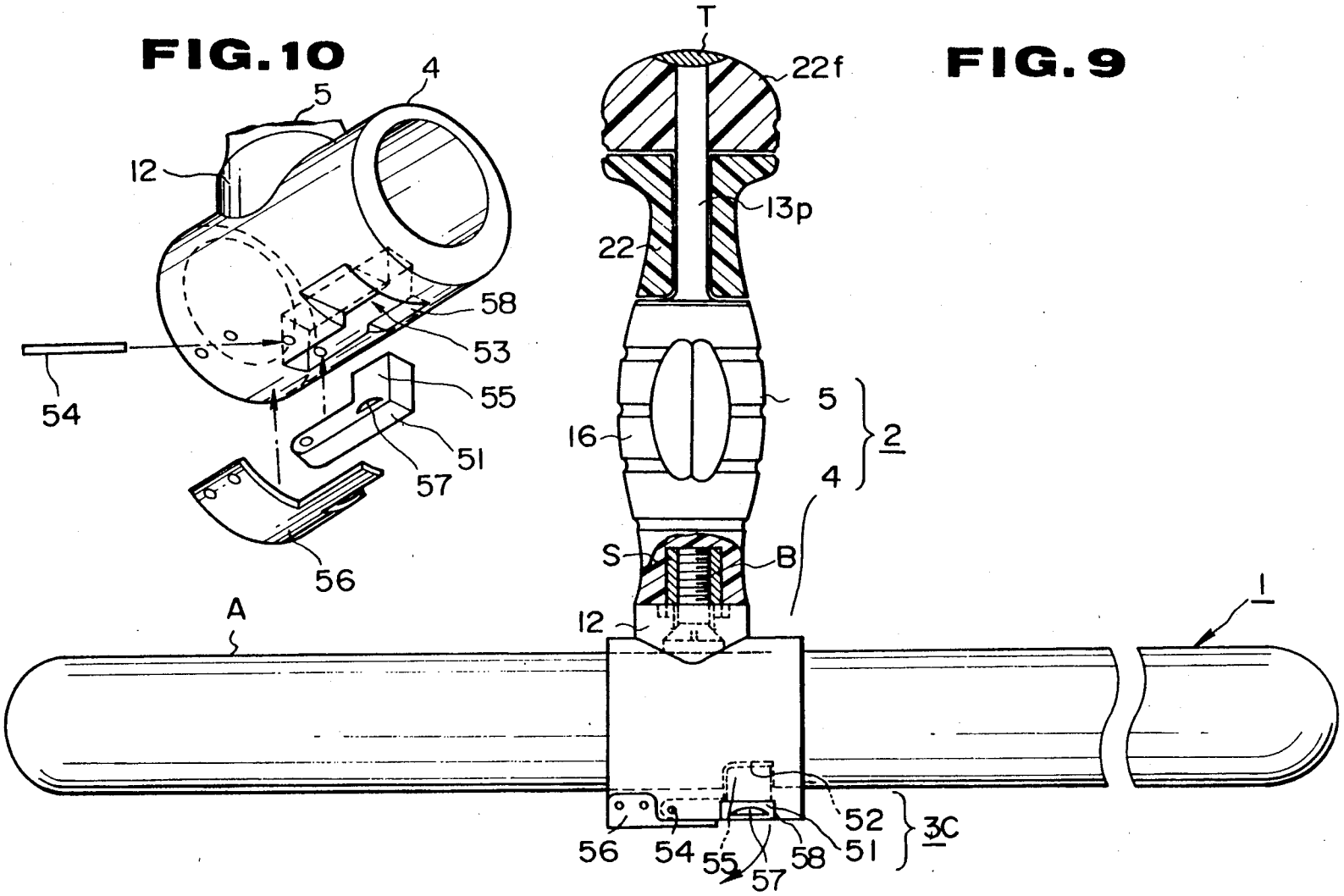
FIG. 9 is a side elevational view partially in vertically cross section of a fourth embodiment according to the present invention.
FIG. 10 is an exploded perspective view of an attachment shown in FIG. 9.

FIG. 9 through FIG. 7 show a second embodiment.

This embodiment is different from the first embodiment in that the forked spring 7 in the first embodiment is replaced with a leaf spring 40.

Figure 5:
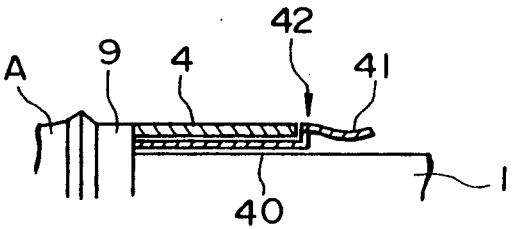
FIG. 5 is a cross sectional view taken along lines 5—5 in FIG. 4.

The leaf spring 40 is fixed at one end to a fixing ring 9, extended axially along the outer surface of a baton main body 1 and attached so that it can resiliently be deformed in the radial direction of a baton main body. As shown in FIG. 5, a protrusion 42 having an inclined surface 41 is formed at the other end of the spring leaf by bending the leaf. The protrusion 42 has a such a shape that it is turned up abruptly and then extended by way of the moderate inclined surface 41 to the end. An insertion groove 43 to be inserted with the leaf spring 40 is formed to the inner surface of an insertion portion 4 of an attachment.

In a case of mounting the attachment 2 to the baton main body 2, the insertion portion 4 is fit around the periphery of the baton main body 1 and then pushed to the base end of a front grip A. Since the top end of the insertion portion 4 of the attachment urges the inclined surface 41 of the leaf spring 40 and presses it to the outer surface of the baton main body 1, the protrusion 42 passes the insertion groove 43. Upon abutment of the top end of the insertion portion 4 against the fixing ring 9, the protrusion 42 is released from the pressing by the insertion portion 4 and returns resiliently and engages the rear end of the insertion portion 4 to inhibit the axial movement of the insertion portion 4. In this way, the attachment can be mounted in one touch action to the baton main body 1.

In a case of detaching the attachment 2 from the baton main body 1, the leaf spring 40 is urged by a hand to the outer surface of the baton main body 1 to release the engagement between the protrusion 42 and the insertion portion 4 and, in this state, the attachment 2 is withdrawn from the baton main body 1.

The crosshandle 5 in this embodiment has not the relatively rotational lower member 14 as in the crosshandle 5 of the first embodiment, but it is of an upper rotational type comprising a static member 16 and a relatively rotational upper member 22. That is, a static member 16 constituting the crosshandle 5 has such an outer shape that its lower end is extended by so much as the relatively rotational lower member 14 in the first embodiment. The static member 16 is fixed by a shaft 13 that stands vertically being screwed directly to the mounting base 12. The lower end of the static member 16 has a protrusion 16A generally of an elliptic transverse cross section, which is engaged with a long hole of the mounting base 12 to make the static member 16 not rotatable.

FIG. 7 and FIG. 8 show a third embodiment, in this embodiment, a coupling device 3B has a male and female thread coupling structure. That is, a latching means comprises a lock nut 45 having a female thread 45*a* at one end. The lock nut 45 is loosely fit to one end of an insertion portion 4 of an attachment 2 rotatably and slightly movably in the axial direction. Then, it is retained from slipping by an engagement between a protrusion 45*b* disposed to the inside of the nut end and a protrusion 46 disposed to the outside of the end of the insertion portion 4.

Means for engaging the lock nut 45 is a cylindrical member 47 having a male thread 47*a* screwed with the female thread 45*a* of the lock nut formed at one end and a protrusion 47*b* formed to the outside at the other end. The cylindrical member 47 is fit around the periphery of an outer cylinder 25 of a baton main body 1 from the side of the protrusion 47*b* and secured at the base end of a front grip A. Further, a key 48 is secured axially to the cylindrical outer surface of the cylindrical member 47 as an anti-rotation protrusion. On the other hand, the insertion portion 4 of the attachment 2 has such an inner diameter as to fit the outer surface of the cylindrical member 47, and an axial key groove 49 is formed to the inner diametrical surface (refer to FIG. 8).

In a case of mounting the attachment 2 to the baton main body 1, the insertion portion 4 is fit over the periphery of the baton main body 1, and enforced to the cylindrical member 47 at the base end of the front grip A to insert the key 48 of the cylindrical member 47 into the key groove 49 of the ring member 4. Then, the lock nut 45 is screwed with the male screw 47*a* of the cylindrical member 47 and clamped. Thus, the end face of the insertion portion 4 is urged to the protrusion 47*b* of the cylindrical member 47 to secure the attachment 2 of the baton main body 1.

In the coupling device 3*b* of this embodiment, the attachment can not be mounted or detached by one touch action, but it has a merit capable of preventing the rotational and axial movement due to the key and thread structure more firmly than that in each of the first and the second embodiments.

FIG. 9 and FIG. 10 show a fourth embodiment.

In this embodiment, a coupling device 3C comprises an engagement structure of a hole and a protrusion.

That is, a latch means is a lock member 51 attached radially movably to an insertion portion 4 of an attachment 2, and a means for engagement therewith is constituted as a recess 52 formed to the circumferential side of the baton main body 1.

In the insertion portion 4 of the attachment, the axis for the inner diameter is made eccentric relative to the axis of the outer diameter and, as shown in FIG. 10, the thickness is made greater on the side opposite to the side mounted with the crosshandle 5. Then, a through hole 53 penetrating the side wall on the side of the increased thickness from the outer to the inner circumferential surfaces of the insertion portion 4 is formed being extended longitudinally. The lock member 51 is fit into the through hole 53 and pivoted by a pin 54 rotatably in the radial direction of the insertion portion 4. A protrusion 55 protruded inward and engageable with the recess 52 is protruded at the top end of the lock member 51. The lock member 51 is always resiliently urged radially and inwardly by an urging leaf spring 56 attached to the outer surface of the insertion portion 4. A nail engagement recess 57 is disposed in the lower portion at the top end of the lock member 51, and a portion of the forward half at the outer circumferential surface of the insertion portion 4 in which the through hole 53 is opened in a rectangular form is recessed to provide a window 58 for exposing the nail engagement recess 57.

In a case of mounting the attachment 2 to the baton main body 1, the baton main body 1 is inserted into the insertion portion 4 and urged to the base end of the front grip A. In the course of the insertion, the protrusion 55 of the lock member 51 is urged by the outer surface of the baton main body 1 and retracted outward against the resiliency of the urging leaf spring 56. Then, upon reaching the base end of the front grip A, the protrusion 55 fits into the recess 52 and both of them are automatically engaged by the resiliency of the spring 56. In this way, the attachment 2 is secured to the baton main body 1 in one touch action.

In a case of detaching the attachment from the baton main body 1, a tip of a nail is engaged to the nail engagement 57 of the lock member 51 to pull out the top end of the lock member 51 outward and engagement between the recess 52 and the protrusion 55 is released. Then, the attachment can be withdrawn from the baton main body 1.

The coupling device 3C of this embodiment provides a merit that the structure is firm and has no portion of greatly protruding to the outside of the insertion portion 4 in the coupled state, so that it is not caught during manipulation of the police baton or is less damaged by the hitting with an opponent's weapon.

The baton main body 1 of this embodiment is a non-telescopic single rod, different from each of the embodiments described above.

Figure 4:
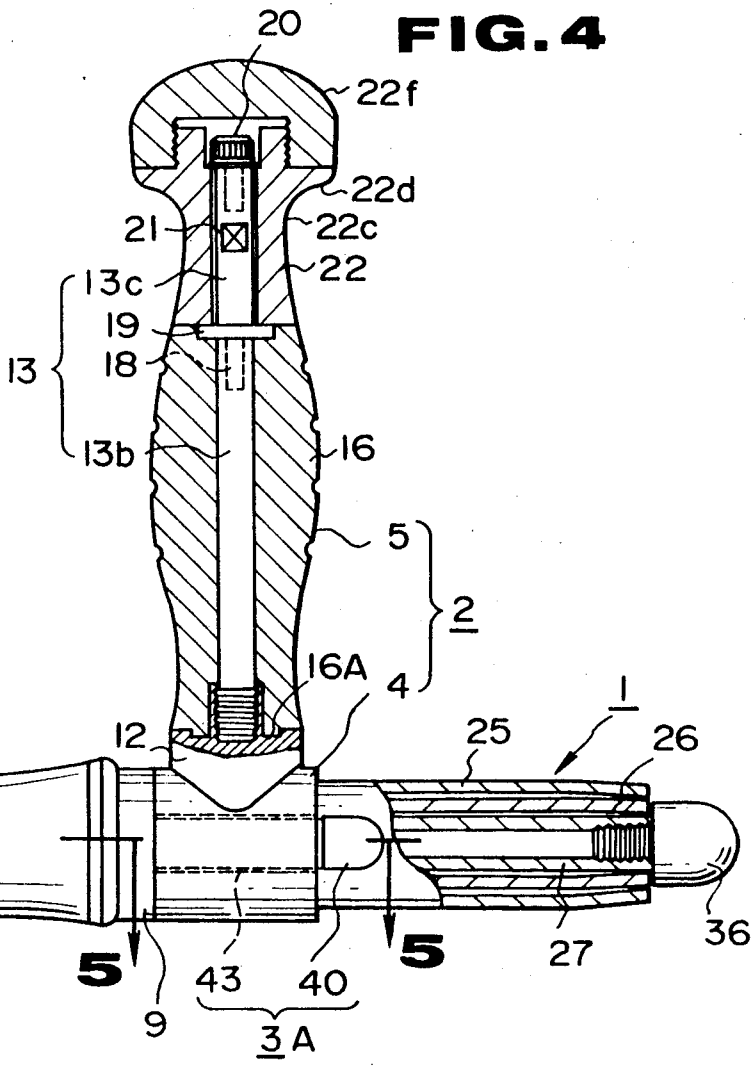
FIG. 4 is a side elevational view partially in vertical cross section of a second embodiment according to the present invention.
Figure 6:
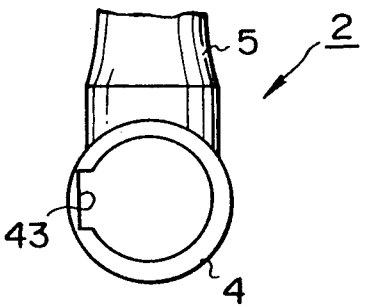
FIG. 6 is a front elevational view of an attachment shown in FIG. 4.

Further, the crosshandle 5 is an upper rotational type but the structure is different from that shown in FIG. 4.

That is, the static member 16 made of a synthetic resin has a female receptacle S formed by insert-molding at the lower end thereof and a shaft 13*p* protruded at the upper end surface by one piece molding. Then, a relatively rotational upper member 22 is rotatably fit loosely around the periphery of the shaft 13*p* and, further, a cap 22*f* made of a synthetic resin is fit over around the periphery of the shaft, and the cap 22*f* and the shaft 13*p* are welded to each other at the top T.

The crosshandle 5 having thus been constituted is secured by a setting screw B in thread-coupling with the female receptacle S through the inner surface of the insertion portion 4.

Figure 11:
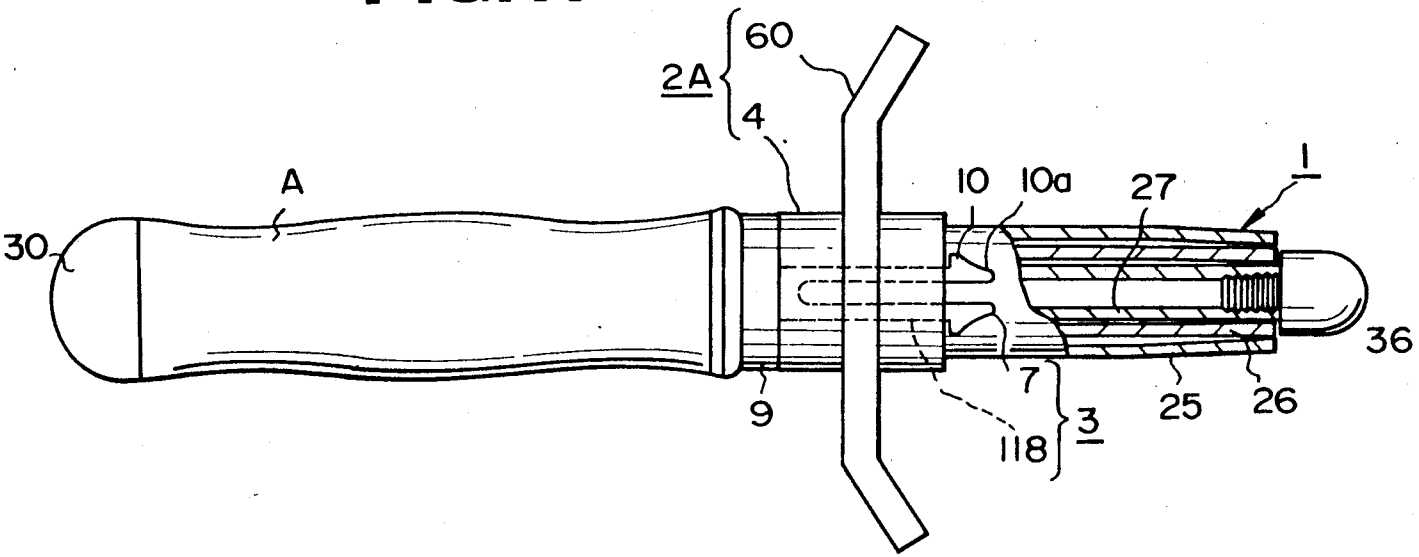
FIG. 11 is a side elevational view partially in vertically cross section of a fifth embodiment according to the present invention.
Figure 12:
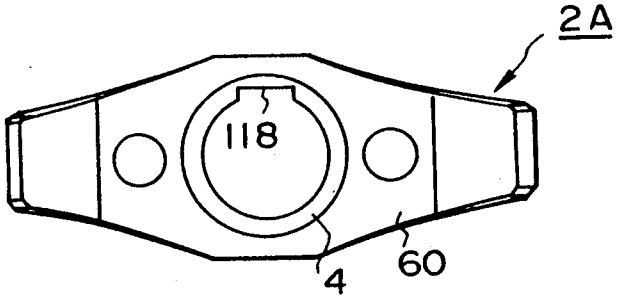
FIG. 12 is a front elevational view of an attachment shown in FIG. 11.

FIG. 11 and FIG. 12 show a fifth embodiment.

This embodiment has the same coupling device 3 as that of the first embodiment, but it is different from the latter in that the extended portion of the attachment 2A is a guard 60 instead of the crosshandle 5. The guard 60 is integrally secured to the cylindrical surface of an insertion portion 4 by means of welding or the like. The size, shape, thickness or the like of the guard 60 is not restricted only to that shown in the illustrated embodiment but the guard may be formed optionally.

Since a hand gripping a front grip A is protected by the attachment of the guard 60 in one touch action to a baton main body 1 as a telescopic rod-like police baton, countermeasure to the offense of an opponent, in particular, having a weapon such as a rod or cutlery can be much facilitated as compared with the case of the police baton with no guard.

Figure 13:
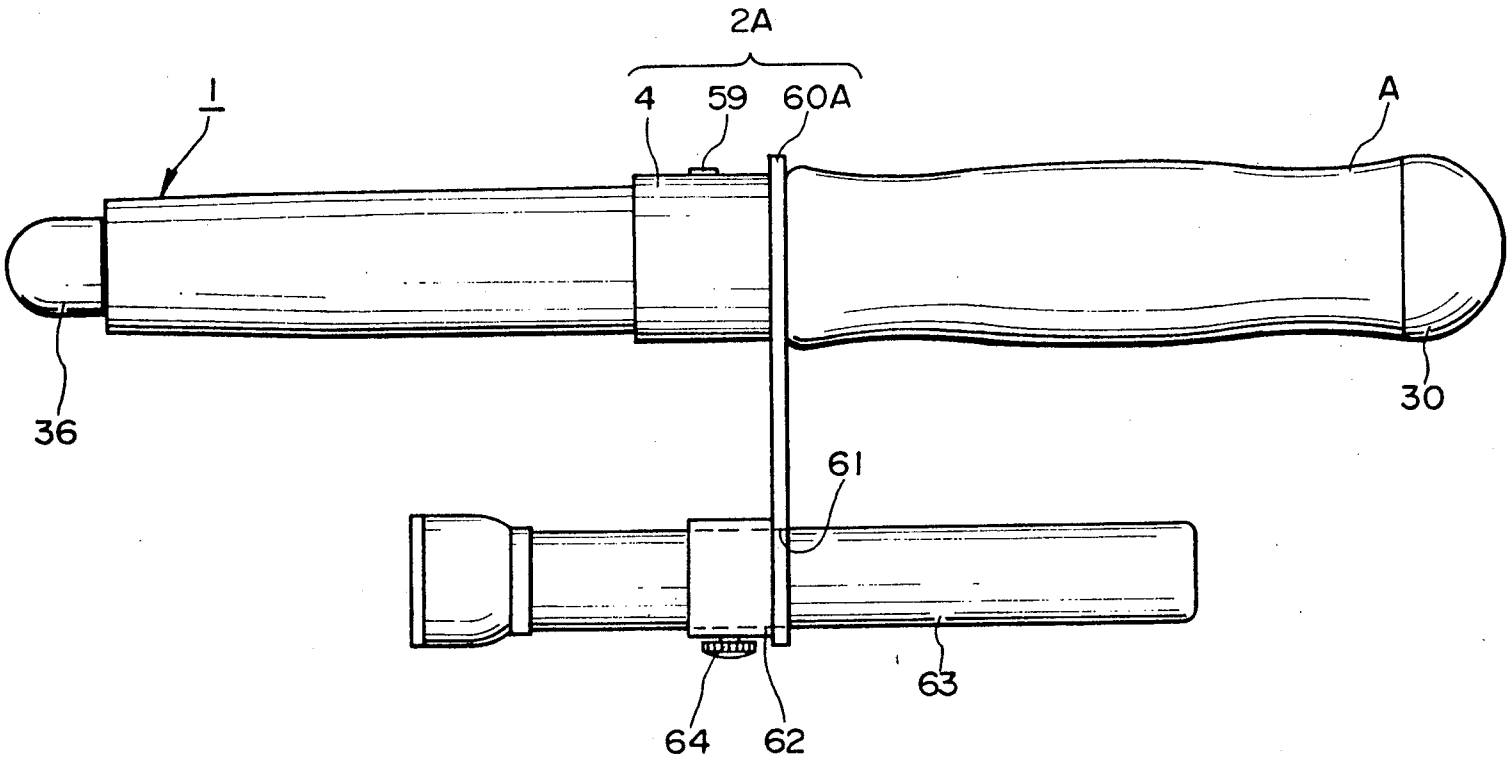
FIG. 13 is a side elevational view of a sixth embodiment according to the present invention.
Figure 14:
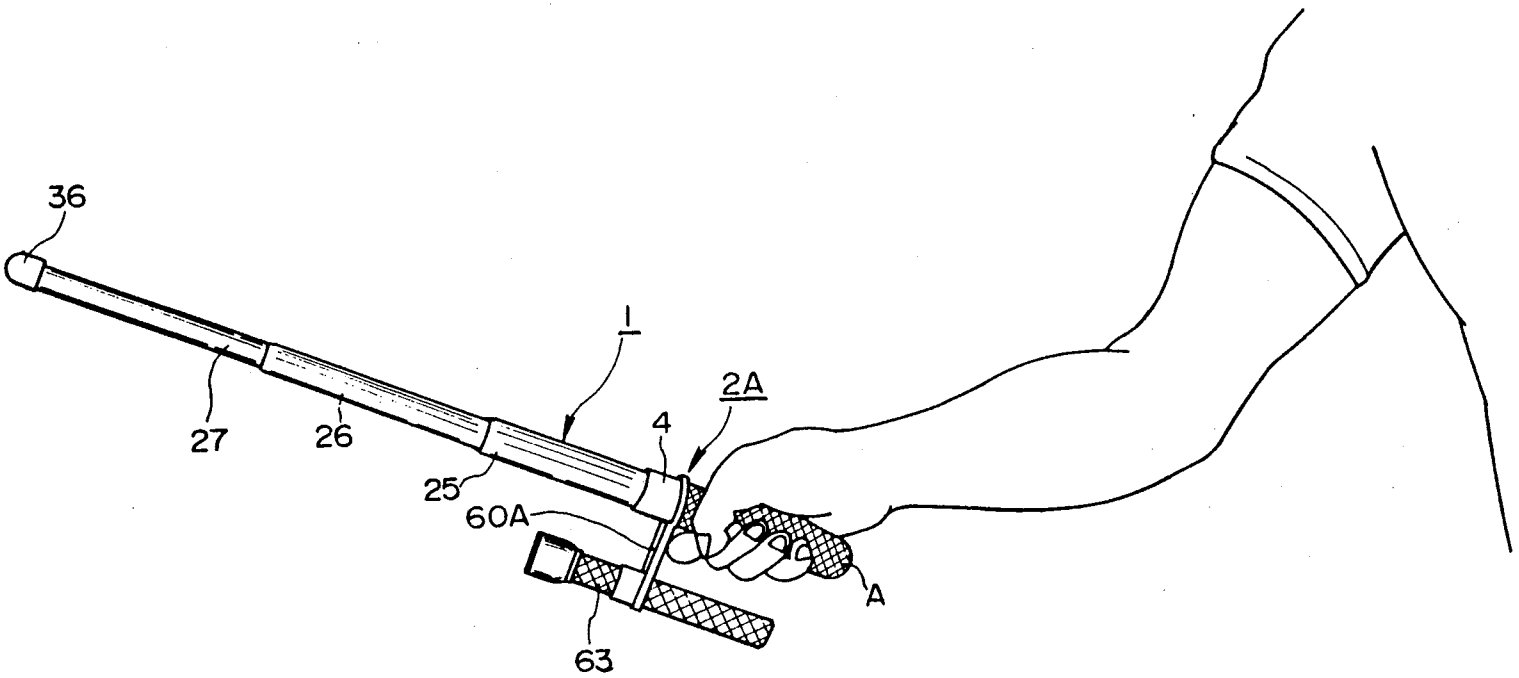
FIG. 14 is a view illustrating the way of using the embodiment shown in FIG. 13.

FIG. 13 and FIG. 14 show a sixth embodiment which is a modified embodiment of the fifth embodiment described above.

In this embodiment, an insertion portion 4 of an attachment 2*a* is secured by a setting screw 59 to a baton main body 1. Further, a guard 60A as an extended portion is disposed only on one side of the insertion portion 4. Further, the guard 60A has, at its terminal end, a through hole 61 and a small cylinder 62 welded coaxially therewith. A lamp 63 as a light shooting device is inserted through the through hole 61 and the small cylinder 52 and detachably fixed by a setting screw 64.

Since a user of this police baton can illuminate an opponent by the lamp 63 with the police baton at the ready by gripping the front grip A, it is possible to instantly manipulate the police baton even against sudden attack. Accordingly, it is no more required to additionally carry about a flash lamp as usual, which is extremely advantageous, for example, in night patrol. Further, if a shooting device such as for stimulating gases, for example, tear gas, liquid acoustic wave or electromagnetic wave is detachably attached in addition to the light shooting device described above, it is possible to dazzle or halter the opponent thereto easily suppressing him.

Figure 15:
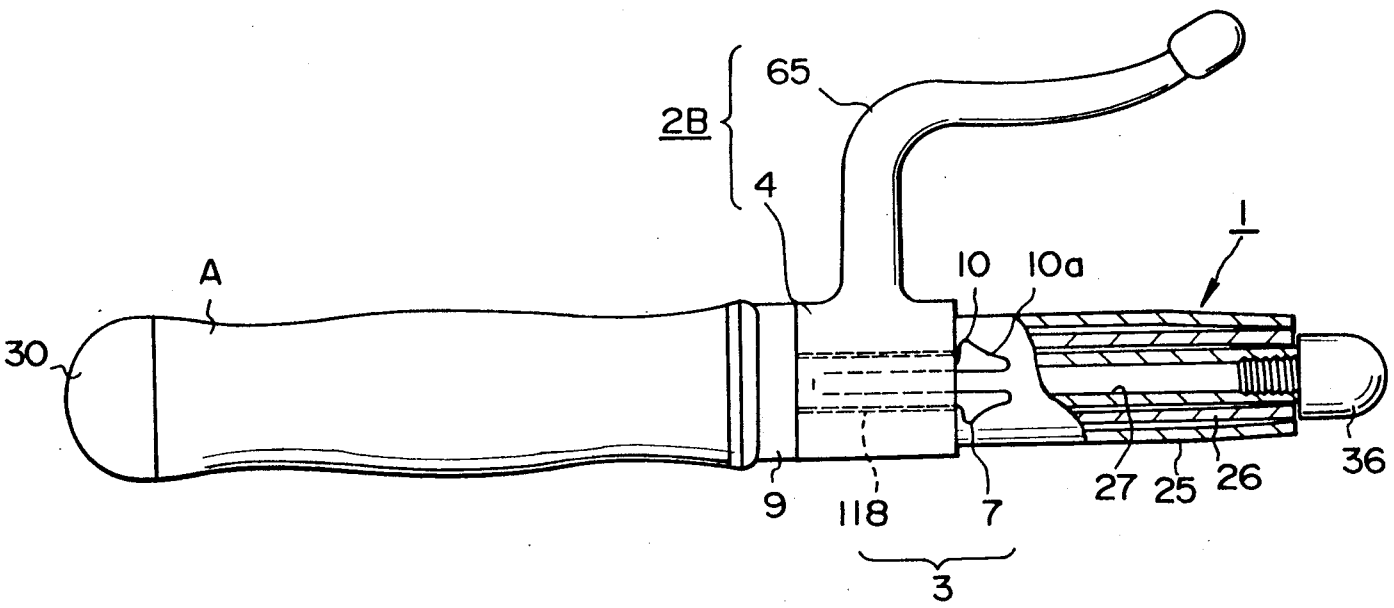
FIG. 15 is a side elevational view partially in vertically cross section of a seventh embodiment according to the present invention.

FIG. 15 shows a seventh embodiment.

The coupling device of this embodiment is substantially identical with that of the first embodiment, only with a difference that an attachment 2B has an extended portion in the form of a single-sided hook (JUTTE-hook) 65 instead of the crosshandle 5. That is, the attachment 2*b* has an L-shaped hook 65 welded as an extended portion to one circumferential side of an insertion portion 4. When the JUTTE-hook 65 is mounted by way of the coupling device 3 to the baton main body 1 in one touch action, not only a hand gripping the front grip A is protected but also more positive countermeasure is enabled than in a case of using the guard 60 such as of wrenching off an opponent's weapon such as a rod or cutlery by putting it between the baton main body 1 and the JUTTE-hook 65.

Figure 16:
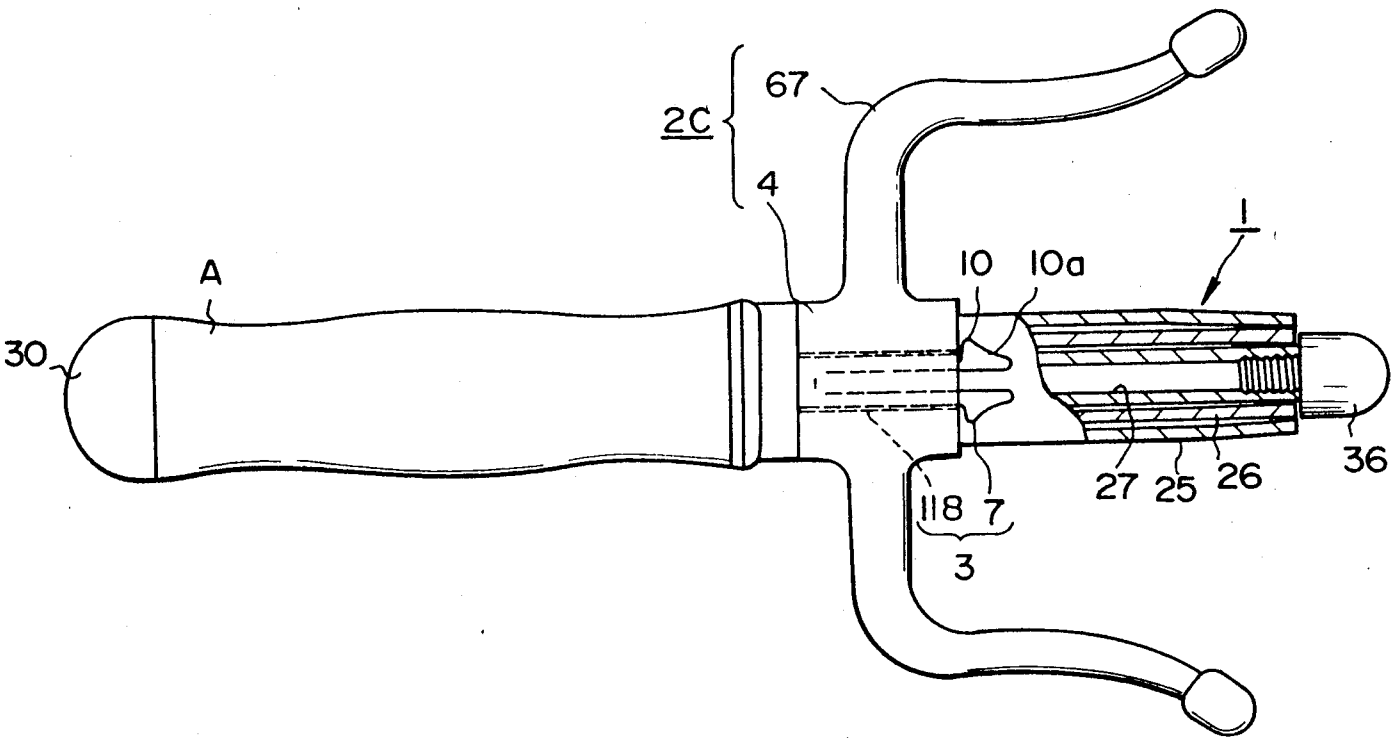
FIG. 16 is a side elevational view partially in vertically cross section of an eighth according to the present invention.

FIG. 16 shows an eighth embodiment.

In this embodiment, the coupling device 3 is also substantially identical with that of the first embodiment, only with a difference that the extended portion of an attachment 2C the form of a crotched-hook (SAI-hook) 67 instead of the crosshandle 5. That is, the extended portion in this embodiment is formed as the SAI-hook 67 by welding L-shaped hooks on both right and left circumferential sides of the insertion portion 4 of the attachment 2C respectively.

An identical function with that of a SAI which is an ancient weapon can be provided by mounting the SAI-like hook 67 by way of the coupling 3 to the baton main body 1 in one touch action. That is, when the user grips the front grip A normally in the same way as that in the police baton with guard shown in FIG. 14, the hand is protected by the SAI-hook 67 extended on both sides and it is possible, for example, to put an opponent's weapon such as a rod or cutlery between the baton main body 1 and the SAI-hook 67 and wrench it off. Moreover, since the hooks are extended on both sides, it is more advantageous in a case of the JUTTE-hook. Further, if the baton main body 1 is rotated longitudinally by positioning fingers to the base end of the hooks, to momentarily change the normal gripping to the front grip A into reverse gripping, a way of use unique to the SAI is possible such as defending the opponent's strong hitting by an arm covered with the baton main body 1 or thrusting down the opponent even at a close distance at the top end of the front grip A. If the user gets skilled to such maneuver, it can provide a merit capable of freely manipulate the baton main body from normal to reverse gripping, or vice versa, to dazzle the opponent thereby making him difficult to take a countermeasure and easily suppressing him.

As the coupling device in the fifth embodiment (FIG. 11), sixth embodiment (FIG. 13), seventh embodiment (FIG. 15) and eighth embodiment (FIG. 16), the coupling device 3 comprising a combination of the forked spring 7 and the insertion groove 8 may be replaced with a coupling device 3*a* comprising a combination of the leaf spring 40 and the insertion groove 43. Further, it is of course possible to use a coupling device 3B comprising a combination of the lock nut 45 and the cylindrical member 47 or a coupling device 3C comprising a combination of the lock member 51 and the recess 52.

Referring to the type of the crosshandle 5, although explanations have been made to the upper and lower rotational type comprising both of the relatively rotational lower member 14 and the relatively rotational upper member 22 and the upper rotational type comprising only the relatively rotational upper member 22 and not having the relatively rotational lower member, any of such types may be adopted in each of the embodiments and, further, a non-rotational type not having the relatively rotational member may also be used.

The shape, the structure, the mounting structure or the like for the gripping portion and the shaft 13 of the crosshandle 5 may not be restricted only to those of the illustrated embodiments but various modifications are possible.

Referring to the baton main body 1, although the explanations have been made so far to the non-telescopic type only for the fourth embodiment and to the telescopic type for other embodiments, the baton main body may be the non-telescopic type throughout the embodiments.

As already proposed by the present applicant in the prior applications, the top end of the baton main body 1 may be made hollow in a non-telescopic type as well as in a telescopic type and granular, rod-like or like other weights may be charged to the top end of the baton main body to increase the impact shock of the baton main body 1 also in the police baton of the present application.

In the multi-functional police baton, as has been described above, since various kinds of attachments such as a crosshandle, a guard, a single-sided hook or crotched hook can be mounted detachably by way of a coupling device, it is possible to select police batons as required including police baton with crosshandle or guard, of any one of types JUTTE-type or SAI-type police baton and advantages of the respective types can be utilized most effectively.

Further, if the attachment is detached, it is extremely convenient to transport or carry about. In particular, if the police baton is of the telescopic type, it can be carried about, for example, under trousers without being observed, and the application range of the police baton can be greatly extended than usual.

FIG. 17 through FIG. 22 show a ninth embodiment of the attachment.

An attachment 2 comprises a cylindrical insertion portion 4 to which a police baton main body 1 is inserted and a crosshandle 5 extended sideways of the insertion portion 4 and having a length enough to be gripped by one hand. A coupling means 3 comprises a retainer ring 6 as a latch means and a retainer ring engaging recess 76 as a means for engagement with the latch means.

Figure 18:
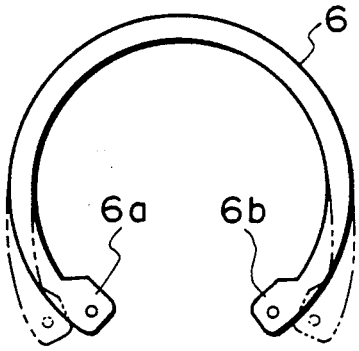
FIG. 18 is a front elevational view of a retainer ring shown in FIG. 17.

As shown in FIG. 18, the retainer ring 6 is a resilient member having a generally C-shaped outer configuration and it has protrusions 6*a*, 6*b* radially protruding inward formed at both ends opposing to each other with a gap. The ring 6 can be resiliently deformed and extended by external force.

Figure 19:
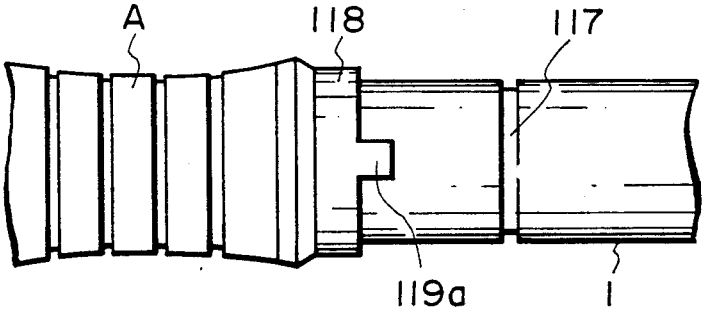
FIG. 19 is a side elevational view for a portion of a police baton main body shown in FIG. 17.

As shown in FIG. 19, an annular groove is disposed to the outer surface of the police baton main body 1 as a retainer ring engaging recess 117 for engagement with the protrusions 6*a*, 6*b* of the retainer ring. Further, a fixing ring 118 is secured to the base end of a front grip A by means of shrink fit, screwing, welding or bonding. The fixing ring 118 has an axial protrusion 119*a* as a male anti-rotation means for the attachment 2.

Figure 20:
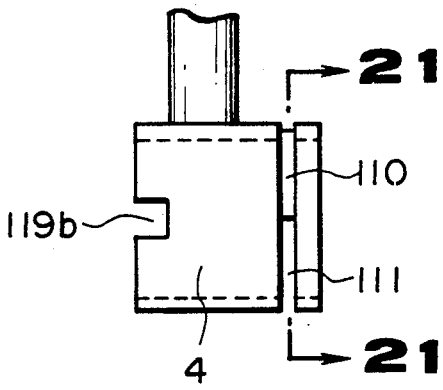
FIG. 20 is a side elevational view of an insertion portion for an attachment shown in FIG. 17.
Figure 21:
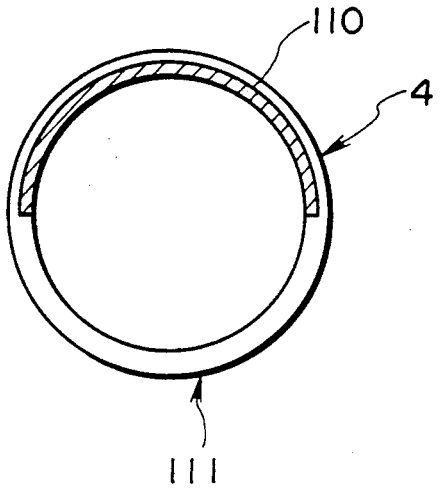
FIG. 21 is a vertical cross sectional view taken along lines 21—21 in FIG. 20.
Figure 22:
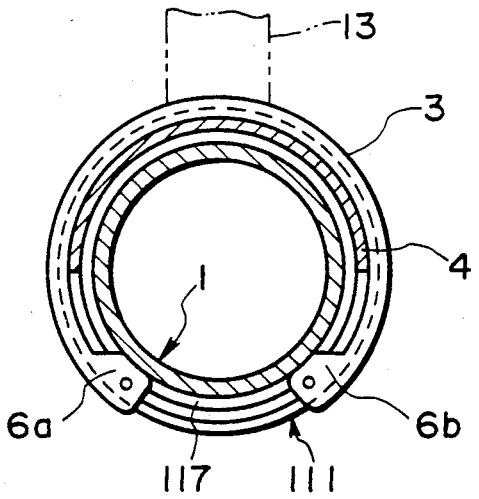
FIG. 22 is a cross sectional view taken along lines 22—22 in FIG. 17.

As shown in FIG. 20, an annular retainer ring groove 110 is disposed to the outer surface near one end of the insertion portion 4 of the attachment 2. The retainer ring groove 110 has a size capable of fitting the retainer ring 6 and a portion of the groove bottom is cut out to form a slit-like opening 111 as shown in FIG. 21. Further, a female recess 119*b* is formed to the other end of the insertion portion 4 as an anti-rotation means for the attachment 2. Then, the retainer ring 6 is mounted to the retainer ring groove 111 by utilizing the resilient deformation, and the protrusion 6*a*, 6*b* protrude through the opening 111 of the retainer ring groove 110 further inward from the inner circumferential surface of the insertion portion 4.

The crosshandle 5 of this embodiment of is of the upper and lower rotational type.

The operation of this embodiment will now be explained.

The attachment 2 can be mounted to the baton main body 1 by merely inserting the baton main body 1 into the insertion portion 4 and urging it as far as the base end of the front grip A. The protrusions 6*a*, 6*b* of the retainer ring protruding to the inner surface of the insertion portion 4 are urged and extended urged by the outer surface of the baton main body 1 upon passage through the spherical top end of the baton main body 1. Then, they proceed in the extended state as it is and when the insertion portion 4 abuts against the base end of the front grip A, the protrusions 6*a*, 6*b* of the retainer ring 6 reach the retainer ring engaging recess 117 at the outer surface of the baton main body 1. Then, the protrusions 6*a*, 6*b* resiliently return from their extended state and automatically engage the retainer ring engaging recess 117 (refer to FIG. 22). In this way, the attachment 2 can be mounted in one touch action and the axial movement can be inhibited. The axial rotation of the attachment 2 around the baton main body 1 is inhibited by the engagement between the protrusion 119*a* of the fixing ring 118 and the recess 119*b* of the insertion portion 4. Further, since the insertion portion 4 to which the baton main body 1 is inserted is made as a cylindrical member, axial rattling or jolting of the attachment 2 can be prevented effectively, as well as a perpendicular relation between the baton main body 1 and the crosshandle 5 extended longitudinally side way from the baton main body 1 can be attained easily. Accordingly, when the baton main body 1 is rotationally manipulated by gripping the crosshandle 5, movement of the police baton main body 1 can be controlled smoothly and reliably, enabling to sufficiently provide a performance as the police baton with crosshandle.

In a case where the police baton with crosshandle of this invention is intended to be used as a simple rod-like police baton or if it is intended to be transported or carried about in a compact state, it may be attained by detaching the attachment 2 from the police baton main body 1. Upon detachment, the ends of the retainer ring exposed through the opening 111 of the retainer ring groove 110 of the attachment 2 are widened to extend the ring and the engagement between the protrusions 6*a*, 6*b* of the retainer ring and the retainer ring engaging recess 117 at the outer surface of the baton main body 1 is released and, subsequently, the attachment 2 is withdrawn from the baton main body 1.

Since the retainer ring 6 is fit as it is in the retainer ring groove 110 of the attachment 2 after withdrawn the ring, there is no worry of missing the ring 6.

Description will now be made to other embodiments. Identical or corresponding portions in each of the embodiments carry the same reference numerals for which duplicate explanations will be omitted.

Figure 23:
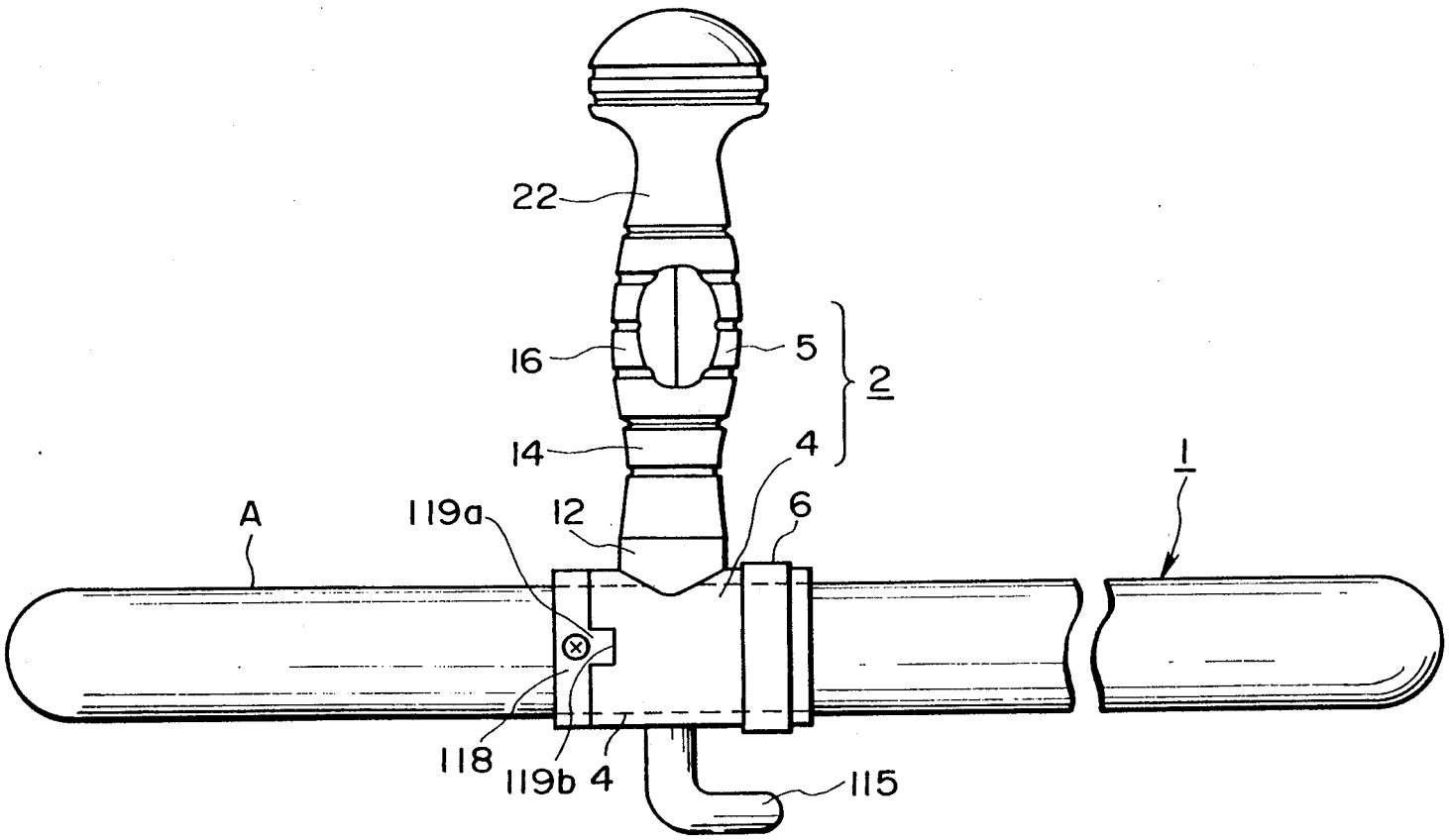
FIG. 23 is a side elevational view partially in vertically cross section of a tenth embodiment to the present invention.
Figure 24:
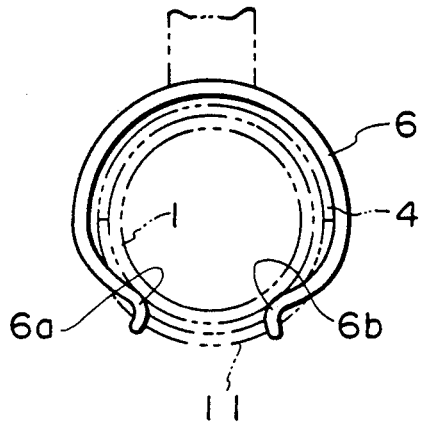
FIG. 24 is a front elevational view of a retainer ring shown in FIG. 18.
Figure 25:
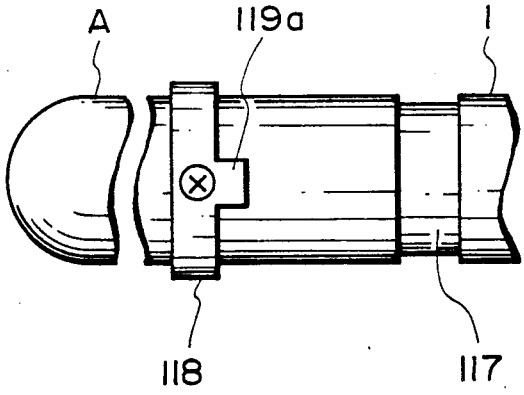
FIG. 25 is a side elevational view for a portion of a police baton main body shown in FIG. 18.

FIG. 23 through FIG. 25 show a tenth embodiment.

The baton main body 1 of this embodiment is a non-telescopic rod member made of a non-metal material such as wood or reinforced synthetic resin. Then, a C-shaped retainer ring 6 of a large width is formed as shown in FIG. 24 and, correspondingly, a retainer ring engaging recess 117 fitting therewith is also has a large width as shown in FIG. 25. To the insertion portion 4 of the attachment 2, an L-shaped hook 115 is disposed as an extended portion on the side opposite to the crosshandle 5 as shown in FIG. 23. The police baton with crosshandle in this embodiment has a merit that it can be easily mass produced and can be provided at a lower cost as compared with the ninth embodiment.

Figure 26:
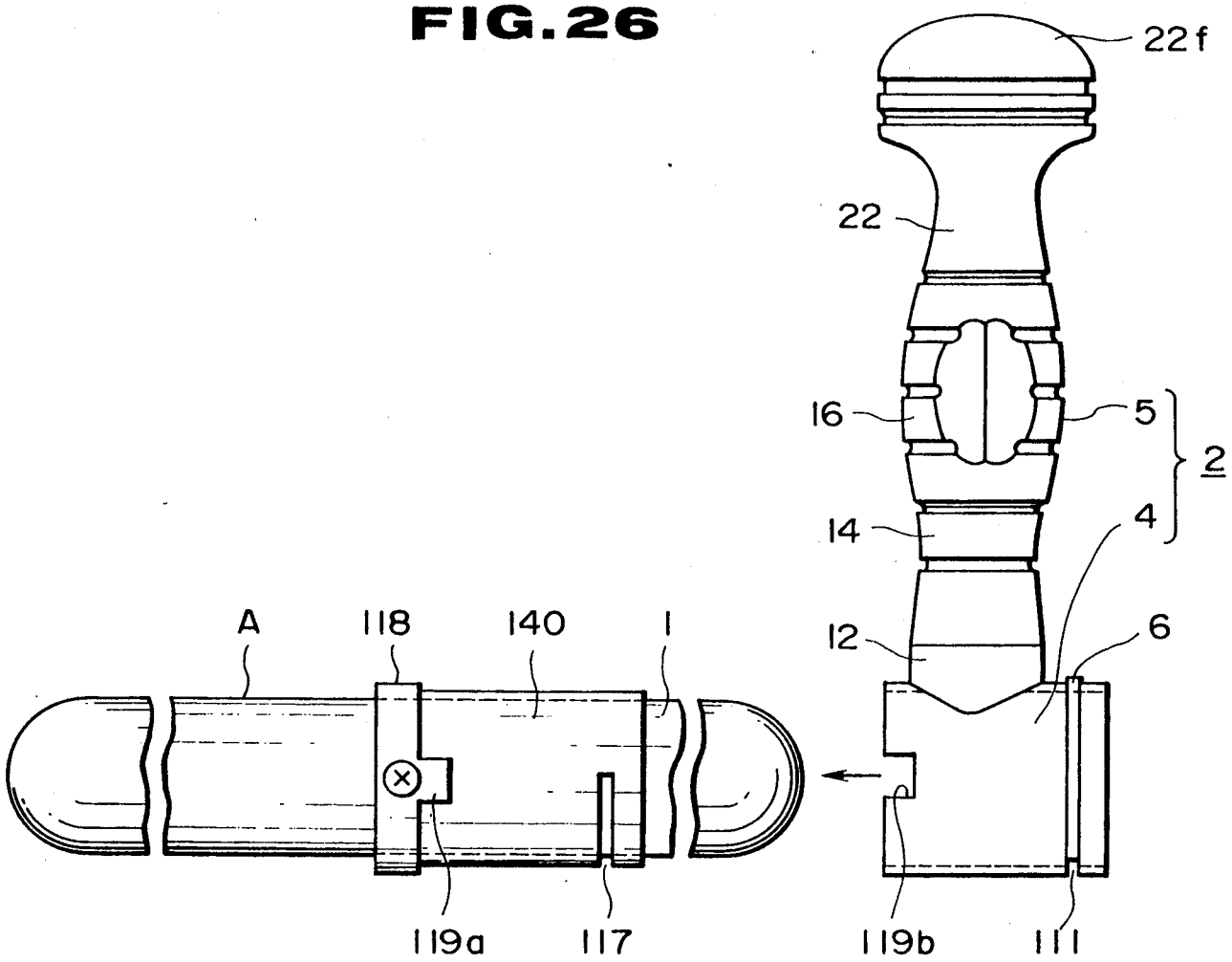
FIG. 26 is an exploded side elevational view of an eleventh embodiment according to the present invention.

FIG. 26 shows an eleventh embodiment.

Figure 17:
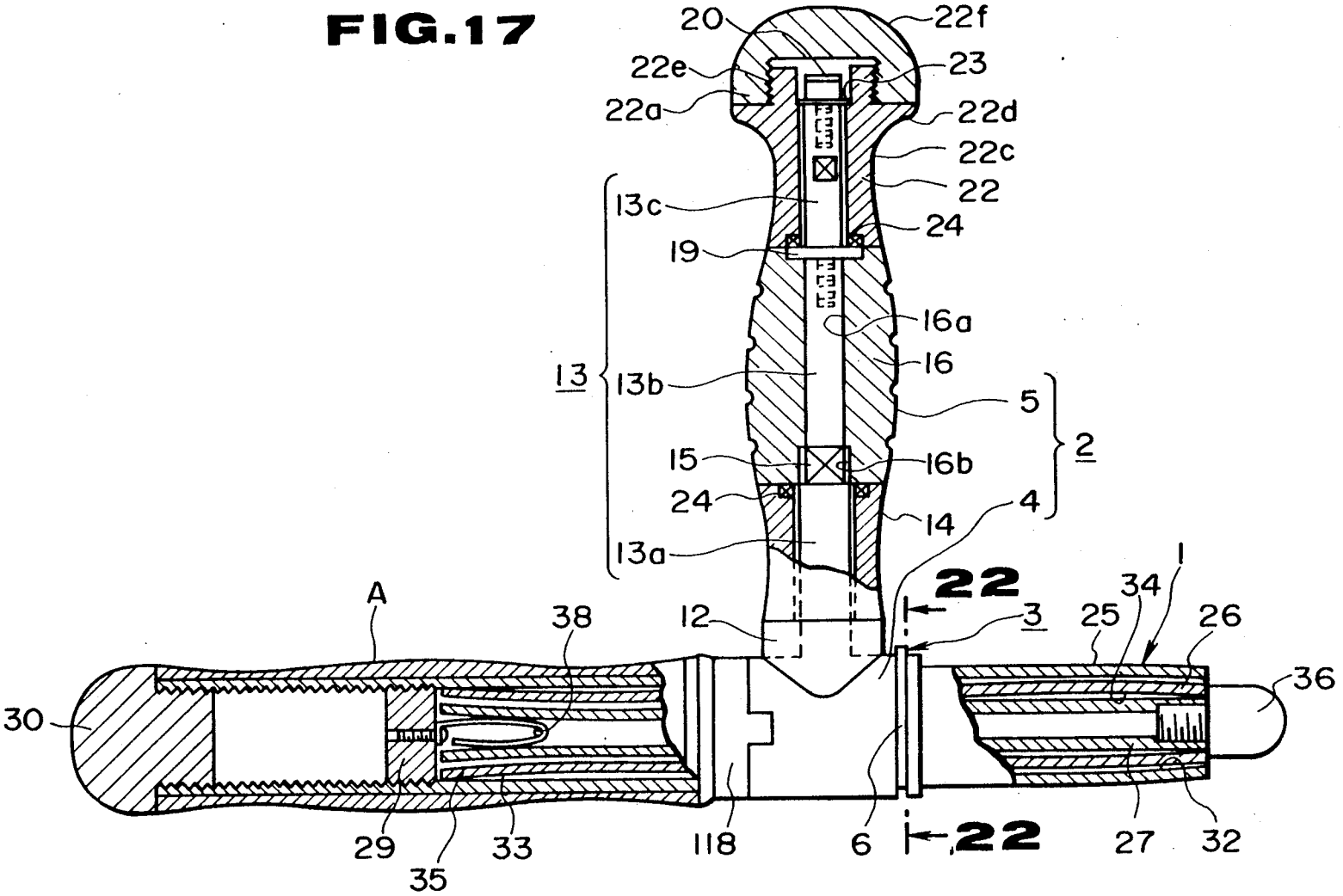
FIG. 17 is a side elevational view partially in vertically cross section of a ninth embodiment to the present invention.

This embodiment is also used particularly preferably in a case where the baton main body 1 is made of non-metal material. The baton main body 1 has no retainer ring engaging recess directly formed thereto. Instead, a metal ring member 140 formed with a retainer ring engaging recess 117 is additionally mounted and secured at a predetermined position of the baton main body 1. The metal ring member 140 is integrally formed with a fixing ring 118 and secured to the baton main body 1 by screwing the fixing ring 118 in this embodiment. Alternatively, it may be formed separately from the fixing ring 118 and may be fixed separately by means of screwing or bonding. Further, instead of addition to the slit-like shape as shown in FIG. 26, the retainer ring engaging recess 117 may be formed as an annular groove as shown in FIG. 17 or the body portion of the metal ring member 140 to the left of the slit 117 in FIG. 26 may be cut into a step instead of the slit. The shape of the retainer ring engaging recess 117 is optional so long as the protrusions 6*a*, 6*b* of the retainer ring 6 can be engaged in an anti-slip off relation to the top end direction of the baton main body 1. The situation is the same also in other embodiments.

Figure 27:
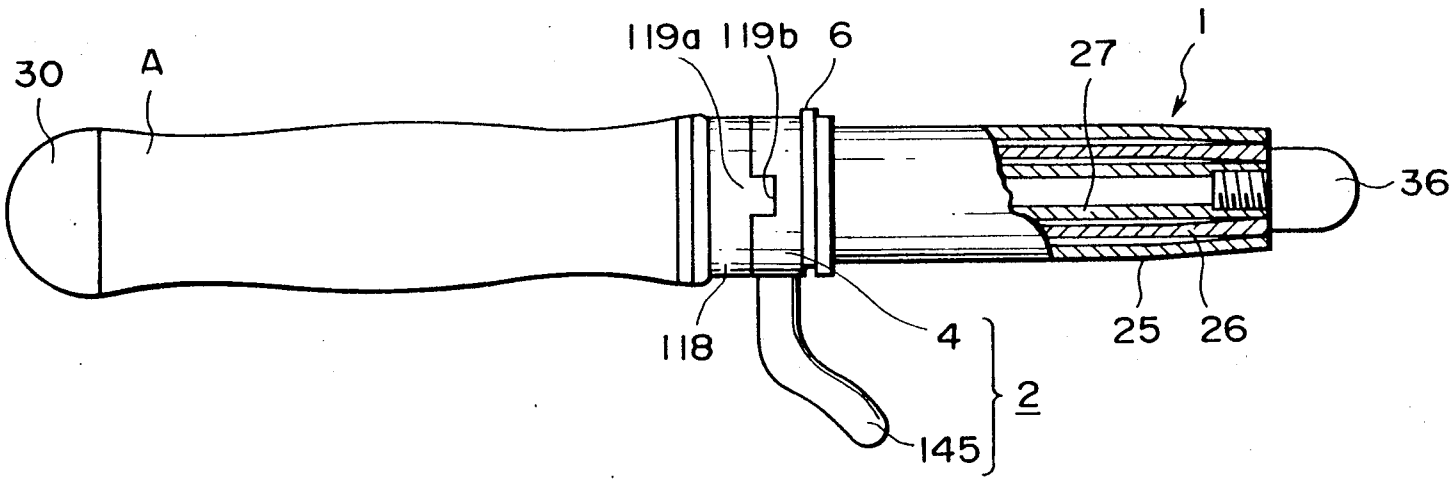
FIG. 27 is a side elevation view partially in vertically cross section of a twelfth embodiment according to the present invention.
Figure 28:
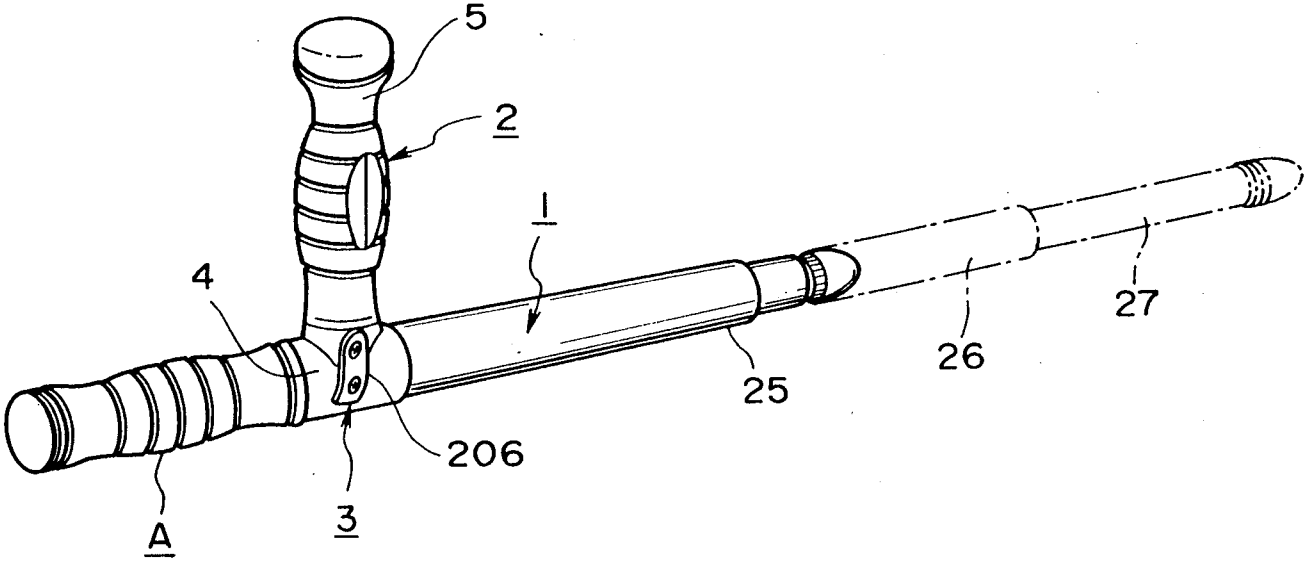
FIG. 28 is an entire perspective view of a thirteenth embodiment according to the present invention.

FIG. 27 shows a twelfth embodiment.

This embodiment is different from the ninth embodiment in that the extended portion of the attachment 2 is formed as a hook piece 145 and the insertion portion 4 is formed as a ring of a narrow width, but the attachment mounting structure is identical with that of the ninth embodiment.

In this embodiment, the extended portion 145 of the attachment is formed as the hook, but the shape of the extended portion of the attachment may optionally be modified, for example, as a guard, a single-sided hook or crotched hook also in the coupling device of this type, although not illustrated.

Descriptions have been made for each of the foregoing embodiments to a case where the C-shaped retainer ring 6 is used as the retainer ring, but it is not restricted to such an illustrated shape but a commercially available member such as an E-shaped retainer ring as specified, for example, in JIS B 2805 can also be adopted.

FIG. 28 through FIG. 31 show a thirteenth embodiment according to the present invention.

An attachment 2 comprises a cylindrical insertion portion 4 to which a baton main body 1 is inserted and a crosshandle 5 as an extended portion extended side way of the insertion portion 4. A coupling means 3 comprises a latch means 206 and an engagement means 209 engaging the latch means 206. A resilient engaging plate is used as the latching means 206, and a pinhole is used as the means 209 for engagement with the latch means 206.

Figure 29:
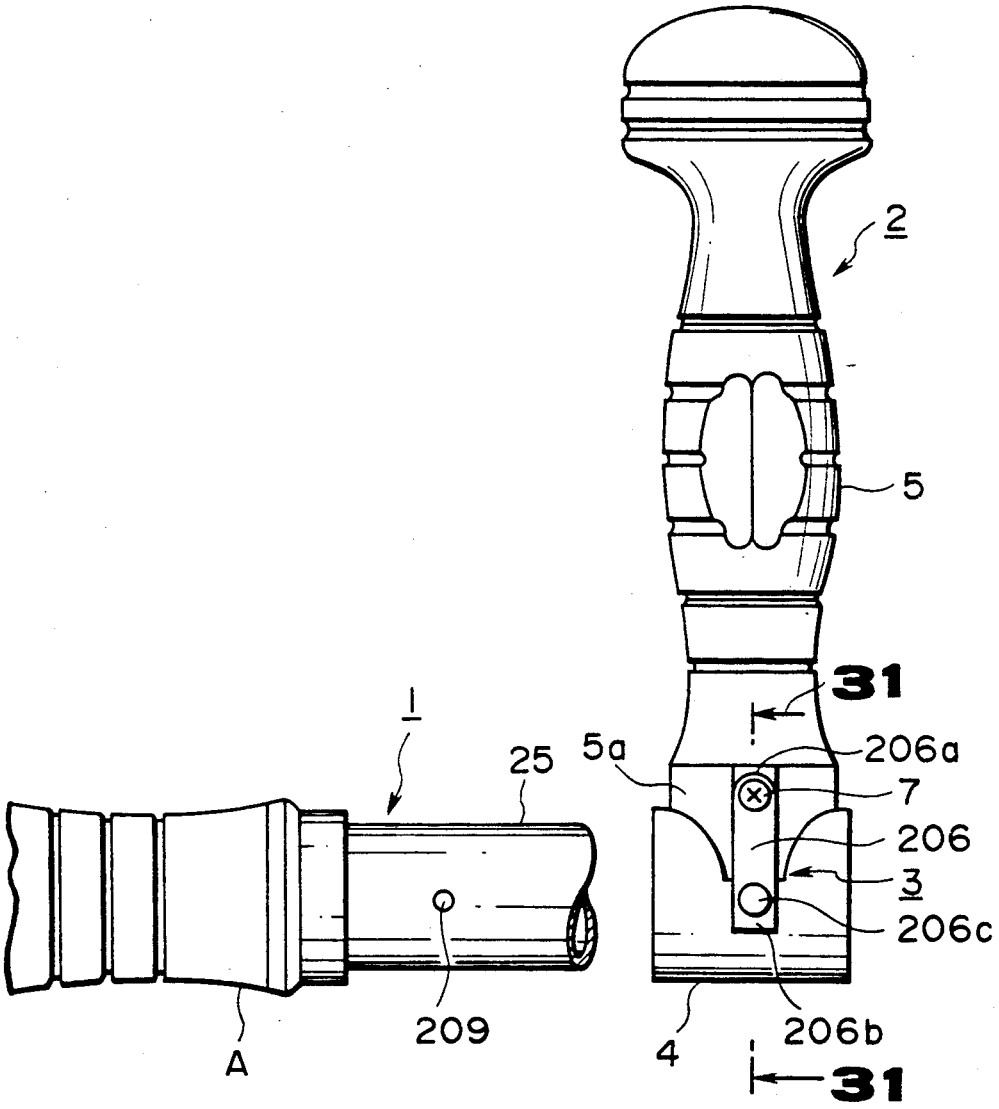
FIG. 29 is a side elevational view for a portion of a mounting structure for police baton attachment shown in FIG. 28.
Figure 30:
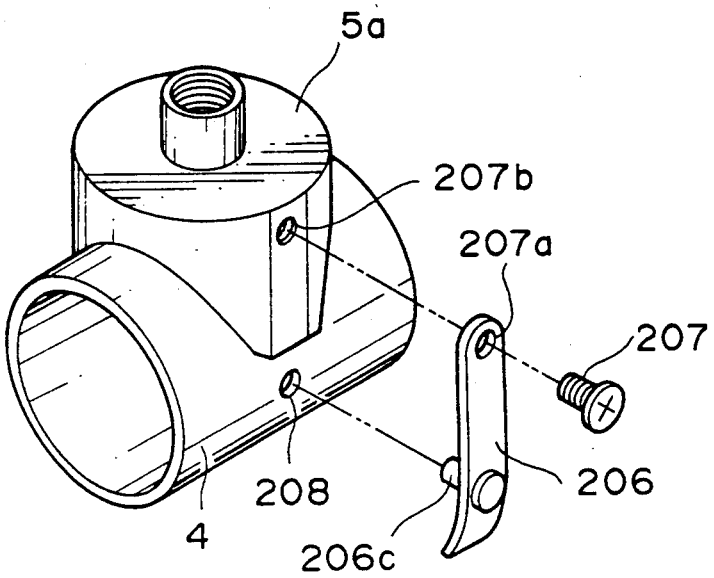
FIG. 30 is an exploded perspective view for a portion shown in FIG. 29.
Figure 31:
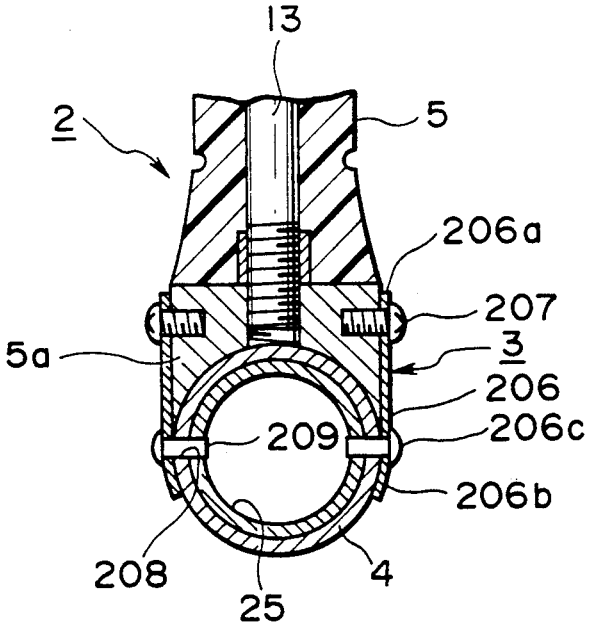
FIG. 31 is a cross sectional view taken along lines 31—31 in FIG. 29.

As shown in FIG. 29 and FIG. 30, the resilient engaging plate 206*b* has a fixed end 206*a* at one end and a free end 206*b* at the other end, in which the free end 206*b* is formed with an engaging protrusion 206*c* that projects inward.

In this embodiment, the resilient engaging plate 206 comprises a pair of two elongate plates made of spring steel extended in the lateral direction of the crosshandle 5. Each of the resilient engaging plates 206 has, at its fixed end 206*a*, an insertion hole 207*a* for a small screw 207 so that the small screw 207 inserted therethrough is screwed and fixed to a threaded bore 207*b* formed on each of the side surfaces of a crosshandle base 5*a* (formed integrally with the insertion portion 4) of the attachment 2. The free end 206*b* is extended toward the side of the insertion portion 4, and the top end is bent so as to be in an intimate contact with the cylindrical insertion portion 4. The engaging protrusion 206*c* on the side of the free end 206*b* has a pin secured by means of pressing or the like. Then, pin hole 208 through which the engaging protrusion 206*c* is passed is formed on each of right and left side surfaces of the insertion portion 4.

On the other hand, a pin hole 209 is formed at the outer surface near the gripping portion A of the baton main body 1 as an engaging portion for engagement with the engaging protrusion 206*c* of the resilient engaging plate 206.

Operation of the coupling device having thus been constituted will now be described.

In a case of mounting the attachment 2 to the baton main body 1, the baton main body 1 is inserted into the insertion portion 4 and pushed to the based end of the gripping portion A. The engagement protrusions 206*c* passing through the pin holes 208 formed in the insertion portion 4, protruding from both right and left sides into the inner surface and opposing to each other are extended being urged by the outer surface of the baton main body 1. The baton main body 1 is enforced in this extended state and, when the insertion portion 4 abuts against the base end of the gripping portion A, the engaging protrusions 206*c* reach the pin holes 209 at the outer surface of the baton main body 1, by which the engaging protrusions 206*c* resiliently return from the extended state and engage the pin holes 209. In this way, the attachment 2 can be mounted by one touch action, and the attachment 2 is neither rotated around the baton main body 1 nor displaced axially. Further, since the cylindrical insertion portion 4 and the cylindrical member 25 fit to the each other in this structure, axial rattling or jolting of the attachment 2 can be prevented effectively, as well as the perpendicular relation between the baton main body 1 and the crosshandle 5 extended longitudinally side way from the baton main body 1 can be attained easily. Accordingly, when the baton main body 1 is rotationally manipulated by gripping the crosshandle 5, movement of the baton main body 1 can be controlled smoothly and reliably enabling to sufficiently provide a performance as the police baton with crosshandle.

Figure 32:
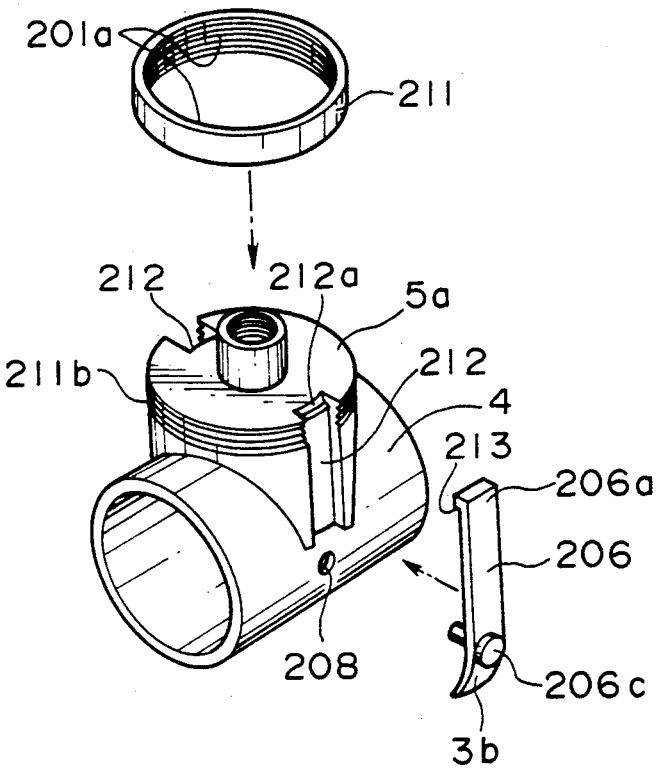
FIG. 32 is an exploded perspective view for a portion of a fourteenth embodiment according to the present invention.

FIG. 32 shows a fourteenth embodiment.

In this embodiment, a resilient engaging plate 206 is fixed at its fixing end 206*a* to a base 5*a* of a crosshandle 5 by a threaded ring 211 having a female thread 211*a* formed along the inner diametrical surface. A female thread 211*b* screwing with the thread 211*a* is formed to the upper outer circumferential surface of the base 5*a*, and resilient engaging plate attaching grooves 212 are formed on both right and left circumferential sides of the base 5*a*. The fixing end 206*a* as an upper end of the resilient engaging plate 206 is bent inward to form a hook 213. The two resilient engaging plates 206 are fit into the resilient engaging plate attaching grooves 212 respectively, and the hooks 23 are engaged to steps 212*a* formed at the upper end of the resilient engaging plate attaching grooves 212. Engaging protrusions 206*c* on the side of the free end 3*b* are passed through pin holes 208 of the insertion portion 4, and the fixing ends 206*a* of the resilient engaging plates 206 are urged by the threaded ring 211 and secured to the base 5*a* by threading or screwing and clamping the threaded ring 211 with the male thread 211*b* of the base 5*a*.

The function of the resilient engaging plate 206 in this embodiment is identical with that of the thirteenth embodiment.

Figure 33:
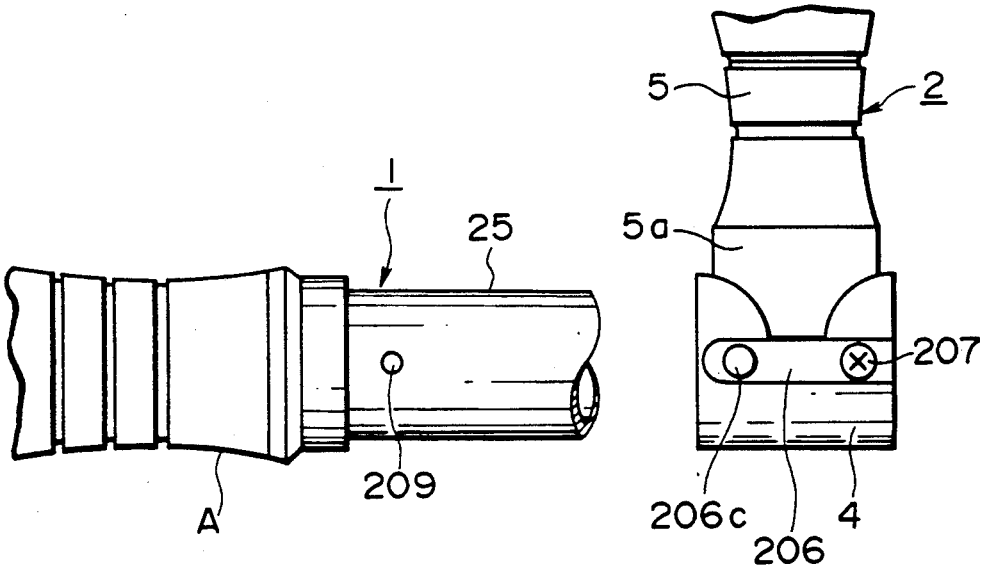
FIG. 33 is a side elevational view for a portion of a fifteenth embodiment according to the present invention.
Figure 34:
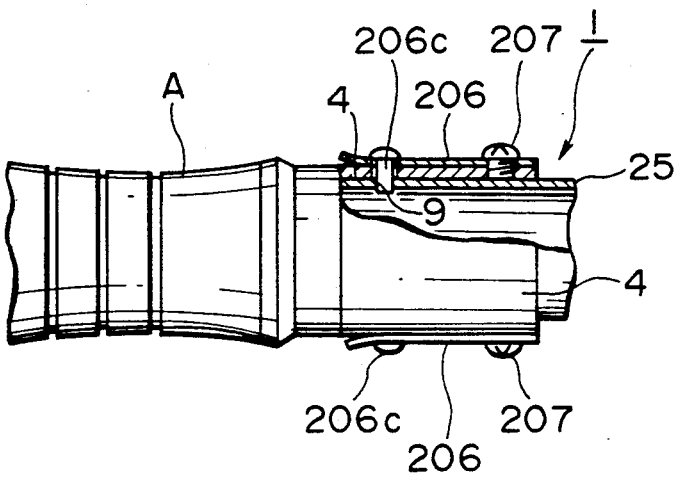
FIG. 34 is a bottom view partially in cross section of an assembled portion shown in FIG. 33.

FIG. 33 and FIG. 34 show a fifteenth embodiment.

In this embodiment, the resilient engaging plate 206 of the above-mentioned embodiment is attached axially along the both of the circumferential sides of the insertion portion 4 of the attachment 2. Other constitutions and operations than the above are substantially the same as those for the previous embodiment.

Figure 35:
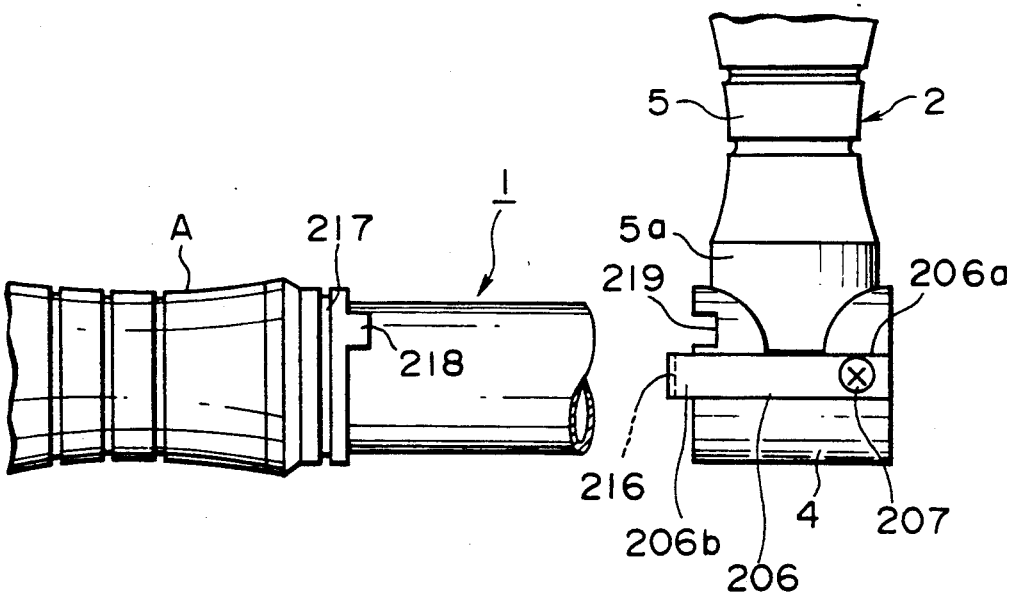
FIG. 35 is a side elevational view for a portion of a sixteenth embodiment according to the present invention.
Figure 36:
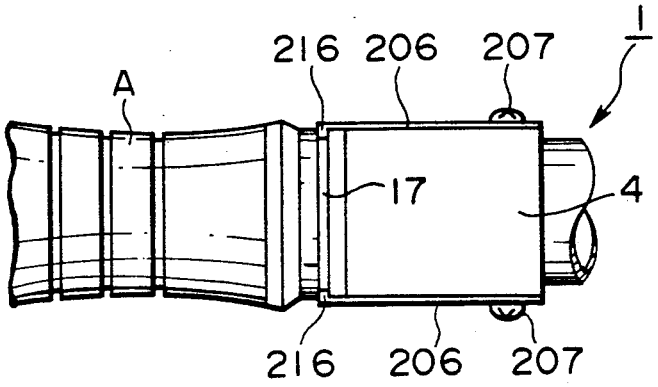
FIG. 36 is a bottom view for an assembled portion shown in FIG. 35.

FIG. 35 and FIG. 36 show a sixteenth embodiment.

In this embodiment, resilient engaging plates 206 are attached in the axial direction along both of the circumferential sides of the insertion portion 4 of the attachment 2 in the same manner as described above. Free end 206*b* is extended out of the end face of the insertion portion 4 and bent inward to form an engaging protrusion 206. A fixing end 206*a* is secured by means of a small screw 207 to the insertion portion 4. On the side of the baton main body 1, an annular engagement groove 217 is formed at the end of the grip A as an engaging portion to which the engaging protrusion 216 is engaged. Further, an anti-rotational protrusion 218 is projected in the direction to the top end of the baton main body 1 at the base of the gripping portion A. A recess 219 is formed to the end of the insertion portion 4 for engaging the anti-rotational protrusion 218.

In this case, the baton main body 1 is inserted into the insertion portion 4 and urged to the base end of the gripping portion A, and the anti-rotation protrusion 218 formed to the baton main body 1 is engaged with the recess 219 formed to the insertion portion 4, and the engaging protrusion 216 of the resilient engaging plate 206 is engaged to the engaging groove 217 of the baton main body 1. In this way, the attachment 2 can be mounted in one touch action and it is neither rotated around nor slipped off axially from the baton main body 1.

Figure 37:
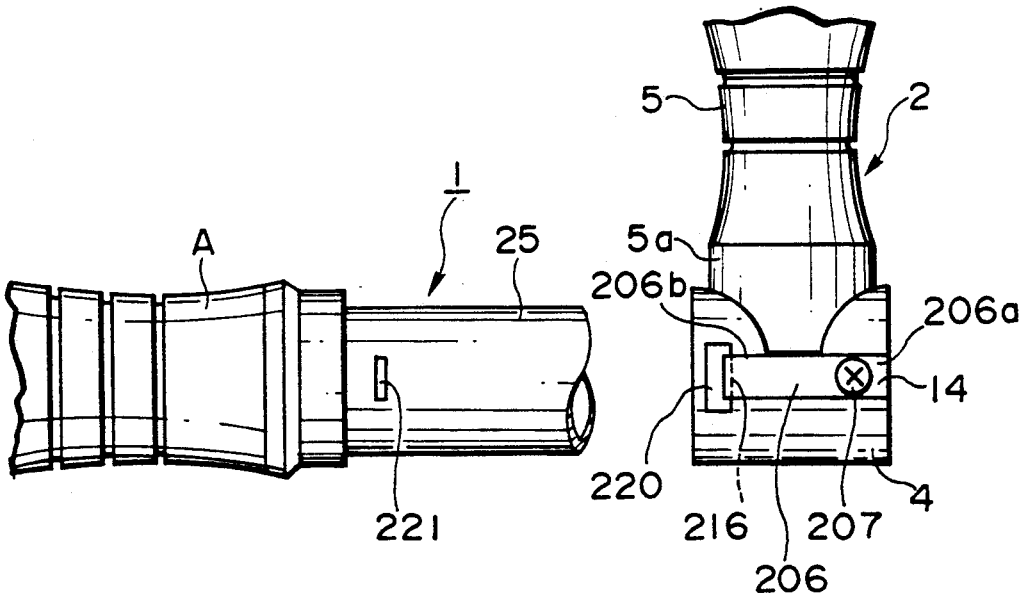
FIG. 37 is a side elevational view for a portion of seventeenth embodiment according to the present invention.
Figure 38:
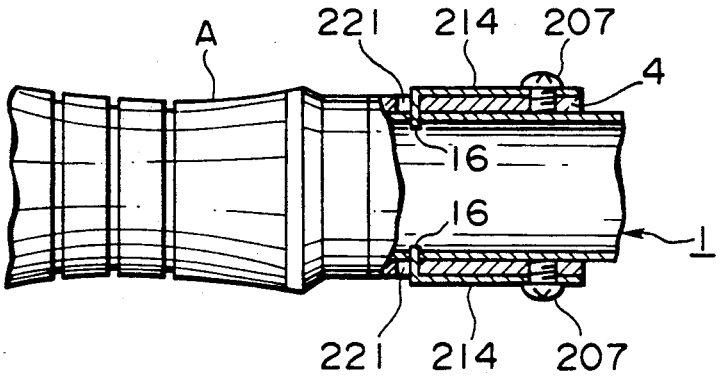
FIG. 38 is a horizontal cross sectional view of an assembled portion shown in FIG. 37.

FIG. 37 and FIG. 38 show a seventeenth embodiment.

In this embodiment, a resilient engaging plate 216 is made shorter than that in the fifteenth embodiment and perforations 220, through which free ends 206*b* of the engaging protrusions 216 are passed, are formed on both circumferential sides of the insertion portion 4 of the attachment 2. On the other hand, square holes 221 are formed near the base end of the gripping portion A of the baton main body 1 as engaging portions for engagement with the engaging the protrusions 216. Since the attachment 2 is inhibited from the rotation and slipping off by the engagement between the engaging protrusions 216 and the square holes 221, the anti-rotation protrusions 218 and the recesses 219 in the sixteenth embodiment are no more required.

Figure 39:
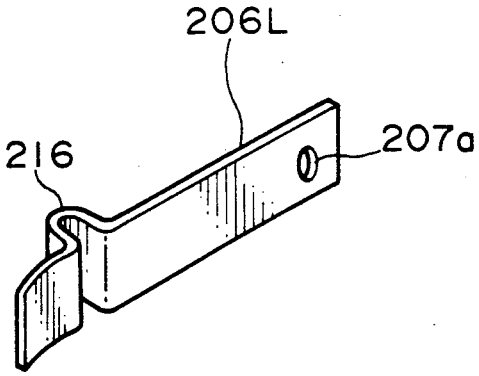
FIG. 39 is a perspective view for a modified embodiment of a resilient engaging plate of an eighteenth embodiment according to the present invention.

Instead of the resilient engaging plate 206, a resilient engaging plate 206L as shown in FIG. 39, in which an engagement protrusion 216 is formed into a U-shaped configuration may also be used.

Figure 40:
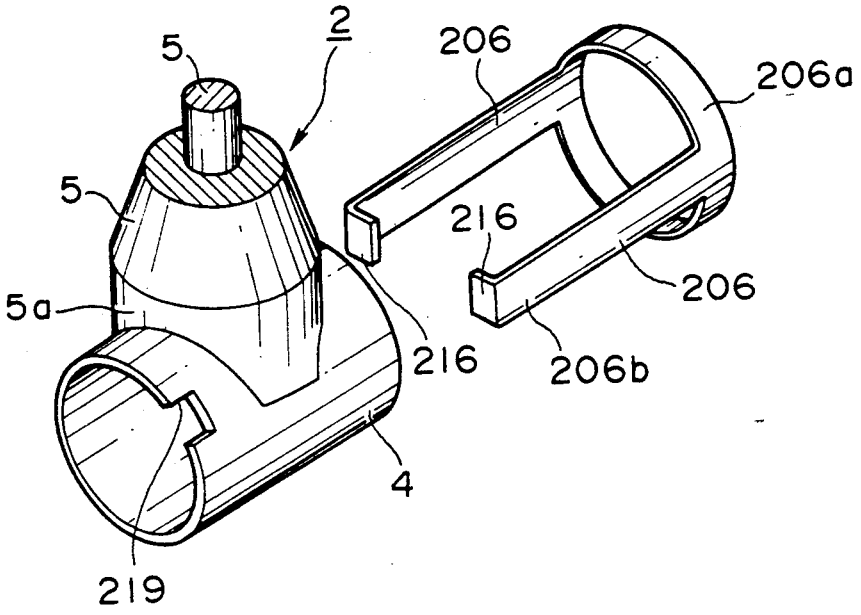
FIG. 40 is an exploded perspective view for a portion of a nineteenth embodiment according to the present invention.
Figure 41:
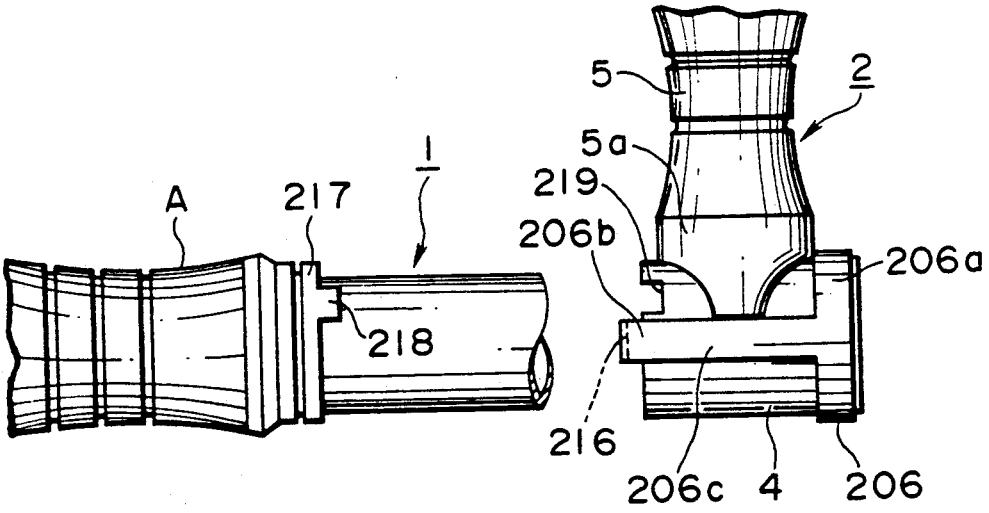
FIG. 41 is a side elevational view for a portion shown in FIG. 40.

FIG. 40 and FIG. 41 show an eighteenth embodiment.

In this embodiment, a resilient engaging plate 206 comprises a cylindrical ring on the side of its fixing end 206*a*, and the fixing end 206*a* is fit and secured to the outer surface of an insertion portion of an attachment 2. Two resilient engaging plates 206 extended axially from the fixing end 206*a* comprising the cylindrical ring along the both circumferential sides of the insertion portion 4 of the attachment 2 are extended at their free ends 206*b* beyond the end face of the insertion portion 4 in the same manner as in the fifteenth embodiment and bent inward to form engaging protrusions 216. The engaging protrusions 216 are engaged to an annular engaging groove 217 formed to the end of the gripping portion A of the baton main body 1, as well as anti-rotation protrusions 218 are engaged with recesses 219 to secure the attachment 2 in the same manner as in the sixteenth embodiment.

Figure 42:
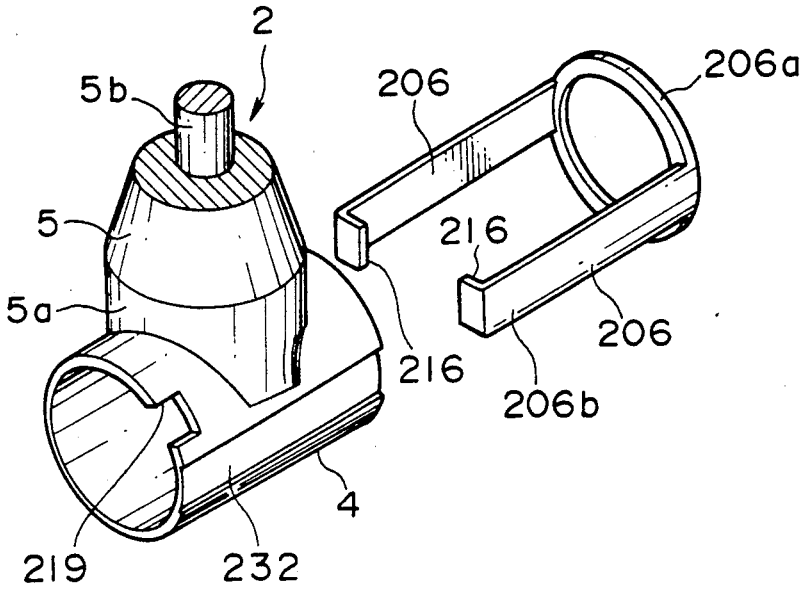
FIG. 42 is an exploded perspective view for a portion of a twentieth embodiment according to the present invention.

FIG. 42 shows a nineteenth embodiment.

In this embodiment, resilient engaging plates 206 are different from those of the seventeenth embodiment in that the cylindrical ring at an fixing end 206*a* is replaced with a flat annular plate. The fixing end 206*a* is abutted against one end face of the insertion portion 4 of the attachment 2, and resilient engaging plates 206 extended axially are fit into axial grooves 232 formed to circumferential sides of an insertion portion 4 and mounted to the insertion portion 4. Other constitutions, functions and effects are identical with those of the eighteenth embodiment.

Figure 44:
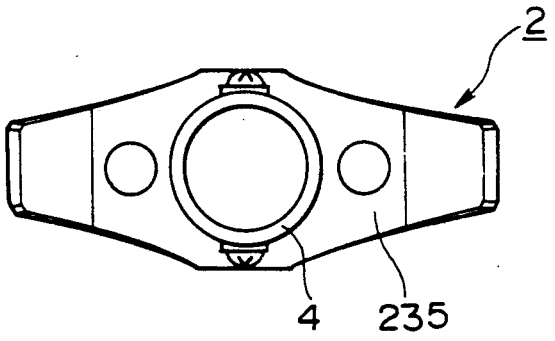
FIG. 44 is a front elevational view of an insertion portion attached with a guard.
Figure 43:
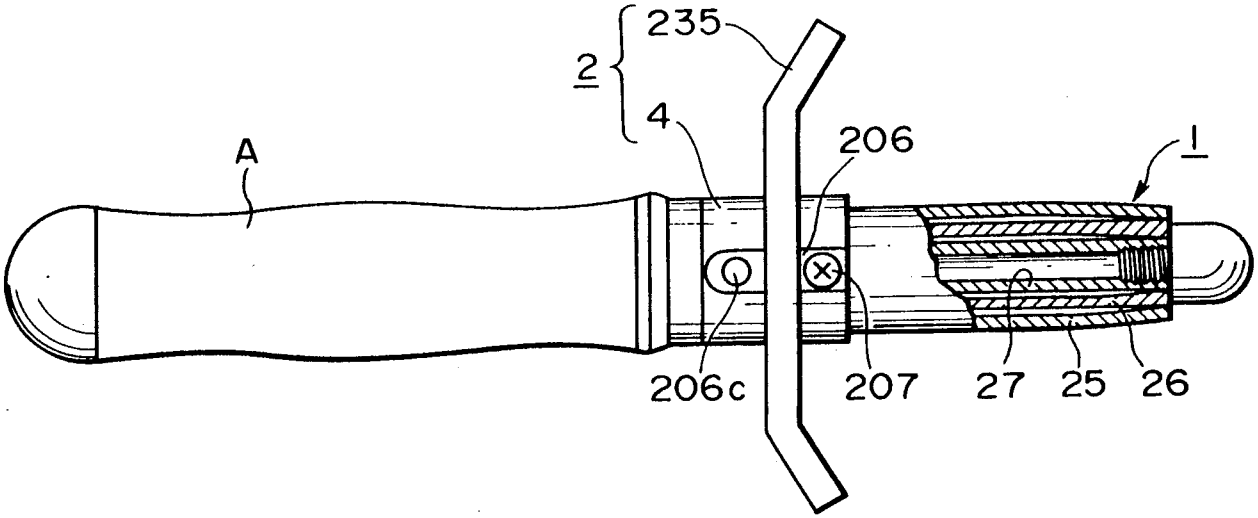
FIG. 43 is a side elevational view for assembling the twentieth embodiment according to the present invention.

FIG. 43 and FIG. 44 show a twentieth embodiment.

This embodiment has a guard 235 as an extended portion of an attachment 2, and the mounting structure is similar to that of the fifteenth embodiment.

Although not illustrated, the coupling device of this embodiment may have an extended portion in the form of a JUTTE-hook or SAI-hook.

What is claimed is:

1. A multi-functional police baton comprising:

a baton main body having a gripping portion at one end in the longitudinal direction, an attachment having a ring-like insertion portion through which said baton main body is inserted and which is detachably fit to a base end position of said gripping portion and an extended portion extended sideways from said insertion portion, and a coupling device of a male and female paired structure comprising a latch means of a movable structure for inhibiting the axial movement and means for engagement with said latch means, in which one of the means of said coupling means is disposed to said baton main body, while the other of the means of said coupling means is disposed to the insertion portion of said attachment.

2. A multi-functional police baton as described in claim 1, wherein the extended portion of the attachment is a crosshandle.

3. A multi-functional police baton as described in claim 1, wherein the extended portion of the attachment is a guard.

4. A multi-functional police baton as described in claim 3, wherein at least one of shooting devices for light, acoustic wave, electromagnetic wave, gas, liquid and solid is detachably mounted to the guard.

5. A multi-functional police baton as described in claim 3, wherein the extended portion of the attachment is a single-sided hook.

6. A multi-functional police baton as described in claim 3, wherein the extended portion of the attachment is a crotched hook.

7. A multi-functional police baton as defined in any one of claims 1 to 6, wherein the latch means in the coupling device is a forked spring capable of deforming resiliency in the lateral direction and means for engagement therewith is an insertion groove for said forked spring, in which said forked spring is mounted at one end thereof to the baton main body, disposed along the longitudinal direction of the outer surface of said baton main body, has jaws formed at the other end thereof for engagement with the insertion portion of the attachment, and said insertion groove for the forked spring is disposed to the inner surface of the insertion portion of said attachment.

8. A multi-functional police baton as defined in any one of claims 1 to 6, wherein the latch means in the coupling device is a leaf spring and a means for engagement therewith is an insertion groove for said leaf spring, in which said leaf spring is secured at one end thereof to the baton main body, disposed along the longitudinal direction and mounted so as to resiliently deform radially from the outer surface of said baton main body and has a protrusion formed at the other end thereof for engagement with the insertion portion of the attachment, and said insertion groove of said leaf spring is disposed to the inner surface of the insertion portion of said attachment.

9. A multi-functional police baton as defined in any one of claims 1 to 6, wherein the latch means in the coupling device is a lock nut having a female thread at one end and a means for engagement therewith is a cylindrical member having a male thread formed at one end thereof for screwing with said lock nut and having an anti-rotational protrusion formed at the outer surface thereof, in which said cylindrical member is secured to a baton main body, and said lock nut is mounted rotatably and axially movably to the end of the insertion portion of the attachment.

10. A multi-functional police baton as defined in any one of claims 1 to 6, wherein the latching means in the coupling device is a lock member having a protrusion and made movable in the radial direction of the baton main body by way of a resilient member and a means for engagement therewith is a recess, in which said recess is formed to the circumferential side of said baton main body and said lock member is mounted radially movably to the insertion portion of the attachment.

11. A multi-functional police baton as defined in any one of claims 1 to 6, wherein the coupling device comprises, a resiliently extendible retainer ring having a generally C-shaped outer shape and having protrusion pieces protruding to the inner radial side, a retainer ring engaging recess formed to the outer surface of the baton main body and a retainer ring groove disposed to the outer surface of the insertion portion of the attachment for fitting said retainer ring, in which a portion of the bottom of said retainer ring groove is cut out to form an opening, and protrusions of said retainer ring are protruded from the inner surface of the insertion portion of said attachment so as to be engageable with the retainer ring engaging recess at the outer surface of said baton main body.

12. A multi-functional police baton as defined in any one of claims 1 to 6, wherein the coupling device comprises, a latch means of a movable structure in which a resilient engaging plate is attached to the circumferential side of the insertion portion of the attachment, with one end being constituted as a fixing end and the other end being constituted as a free end formed with an inwardly protruding engaging portion and means for engagement with said latch means, formed to the outer surface of said baton main body as an engaging portion for engaging the engaging protrusion of said resilient engaging means.

* * * * *